US005136309A

United States Patent [19]

Iida et al.

[11] Patent Number: 5,136,309

[45] Date of Patent: Aug. 4, 1992

[54] LIQUID INJECTION APPARATUS WITH RESIDUAL INK QUANTITY DETECTING MEANS

[75] Inventors: Hiroshi Iida, Machida; Minoru Nozawa; Akihiro Yamanaka, both of Hiratsuka, all of Japan

[73] Assignee: Canon Kabushiki Kaisha, Tokyo, Japan

[21] Appl. No.: 622,187

[22] Filed: Dec. 5, 1990

Related U.S. Application Data

[63] Continuation of Ser. No. 304,898, Feb. 1, 1989, abandoned, which is a continuation of Ser. No. 27,198, Mar. 17, 1987, abandoned.

[30] Foreign Application Priority Data

| | | | |
|---|---|---|---|
| Mar. 19, 1986 | [JP] | Japan | 61-59559 |
| Apr. 8, 1986 | [JP] | Japan | 61-79209 |
| Jul. 3, 1986 | [JP] | Japan | 61-155186 |
| Jul. 3, 1986 | [JP] | Japan | 61-155187 |
| Jul. 3, 1986 | [JP] | Japan | 61-155188 |
| Aug. 28, 1986 | [JP] | Japan | 61-200154 |

[51] Int. Cl.[5] ..... B41J 2/175

[52] U.S. Cl. ..... 346/140 R; 73/723; 250/231.19; 340/618

[58] Field of Search ..... 346/140; 200/83 N, 83 S, 200/83 R; 250/231.19; 340/618, 619; 73/723

[56] References Cited

U.S. PATENT DOCUMENTS

| | | | |
|---|---|---|---|
| 3,093,756 | 6/1963 | Rywak | 307/234 |
| 3,278,704 | 10/1966 | Smith | 200/83 R |
| 3,835,336 | 9/1974 | Block | 307/234 |
| 3,842,224 | 10/1974 | Weis | 200/83 R X |
| 4,178,595 | 12/1979 | Jinnai | 346/140 R |
| 4,187,511 | 2/1980 | Robinson | 346/75 |
| 4,196,625 | 4/1980 | Kern | 346/140 X |
| 4,289,963 | 9/1981 | Everett | 250/231 P |
| 4,342,042 | 7/1982 | Cruz-Uribe | 346/140 R |
| 4,357,748 | 11/1982 | Branson | 200/83 N X |
| 4,415,886 | 11/1983 | Kyogoku et al. | 340/618 |
| 4,432,005 | 2/1984 | Duffield | 346/140 R |
| 4,475,116 | 10/1984 | Sicking | 346/140 R |
| 4,587,535 | 5/1986 | Watanabe | 346/140 R |
| 4,604,633 | 8/1986 | Kimura et al. | 346/140 R |
| 4,610,202 | 9/1986 | Ebinuma et al. | 101/364 |
| 4,636,814 | 1/1987 | Terasawa | 346/140 R |
| 4,719,475 | 1/1988 | Kiyohara et al. | 346/140 |

FOREIGN PATENT DOCUMENTS

| | | |
|---|---|---|
| 8023471 | 11/1980 | Fed. Rep. of Germany . |
| 3147730 | 8/1982 | Fed. Rep. of Germany . |
| 3344447 | 6/1984 | Fed. Rep. of Germany . |
| 3431048 | 3/1985 | Fed. Rep. of Germany . |
| 103877 | 6/1982 | Japan . |
| 2089733 | 6/1982 | United Kingdom . |

*Primary Examiner*—Joseph W. Hartary

*Attorney, Agent, or Firm*—Fitzpatrick, Cella, Harper & Scinto

[57] ABSTRACT

A residual ink quantity detecting apparatus for detecting a residual quantity of ink in a supply source of ink for supplying ink to an ink-jet printer comprises a deviation member, which is connected to an ink supply path extending from the supply source, constitutes part of the path and can be deviated upon change in pressure in the path, an adjusting member for adjusting a deviation of the deviation member in order to set a pressure at which the deviation member is deviated and a detection unit for detecting the deviation of said deviation member.

24 Claims, 17 Drawing Sheets

LIQUID INJECTION APPARATUS WITH RESIDUAL INK QUANTITY DETECTING MEANS

This application is a continuation of application Ser. No. 07/304,898 filed Feb. 1, 1989, now abandoned, which in turn is a continuation of application Ser. No. 07/027,198, filed Mar. 17, 1987, now abandoned.

BACKGROUND OF THE INVENTION:

1. Field of the Invention

The present invention relates to a liquid injection apparatus and, more particularly, to a liquid injection apparatus having a residual ink quantity detecting means for detecting the presence/absence of ink from a change in pressure in an ink supply system and to a residual ink quantity detecting apparatus for detecting a residual quantity of ink in an ink supply source such as an ink tank.

2. Related Background Art

An ink-jet printer, which ejects ink from a small nozzle to record an image or character on a recording medium has become popular. In a printer of this type, no ink ribbon is used, and ink liquid stored in an ink tank is ejected as small ink droplets to a recording medium such as a paper sheet through an injection mechanism of a printing head, which is connected to the ink tank through a tube, thereby recording an image and the like thereon. In the ink-jet printer of this type, a mechanism for detecting a residual quantity of ink in the ink tank is normally arranged in order to prevent print errors due to ink shortage. When the residual quantity of ink becomes insufficient, an alarm sound is produced, thereby urging an operator to refill ink or to exchange an ink tank cartridge.

In some ink-jet printers in which an ink tank as an ink supply source fixed to the main body of the ink-jet printer or a recording head is mounted on a carriage, a conventional residual ink quantity detecting apparatus is arranged on a sub-ink tank mounted on the carriage. In the conventional residual ink quantity detecting apparatus, a float which includes a magnet and moves in accordance with a change in liquid level is detected by a lead switch, or a light emitting means and a light receiving means are arranged, so that when the ink level is decreased below a predetermined value, light emitted from the light emitting means reaches the light receiving means without being sealed by the ink, thereby detecting a residual quantity of ink.

However, in the conventional residual ink quantity detecting apparatus in the ink-jet printer, in particular, when it is provided to a fixed ink tank and the ink tank is flat and is constituted by a flexible bag, a change in liquid level upon decrease in quantity of ink is small. Therefore, the residual quantity of ink cannot be accurately and reliably detected.

The conventional residual ink quantity detecting apparatus must be exchanged together with the ink tank when the ink tank is exchanged. Therefore, the ink tank becomes expensive.

When the residual ink quantity detecting apparatus is provided to a sub-ink tank mounted on a carriage, the liquid level in the sub-ink tank fluctuates when the carriage is moved in a predetermined direction. Therefore, an erroneous operation may occur upon residual ink quantity detection. In addition, an electrical connecting means necessary for the residual ink quantity detecting apparatus is moved together with the carriage. Therefore, the connecting portion may present a reliability problem.

Thus, a residual ink quantity detecting apparatus which is arranged midway along an ink supply path between a recording head and an ink tank has been proposed.

FIG. 1 shows an open-air type conventional residual ink quantity detecting apparatus, as the residual ink quantity detecting apparatus of the above type. An open-air type manometer 200 is arranged midway along an ink supply path. A pair of ink presence/absence detectors 200*a* and 200*b* such as electrodes detect a decrease in ink level I.

FIG. 2 shows a closed type conventional residual ink quantity detecting apparatus. In FIG. 2, a flexible film (diaphragm) 301 constitutes part of an ink supply path. An electrode 300 is provided to the diaphragm 301. A stationary electrode 302 is brought into contact with the electrode 300 when the diaphragm 301 is moved downward in FIG. 2 upon increase in negative pressure in the ink supply path. A spring member 303 biases the diaphragm 301 upward in FIG. 2. Note that as the closed type detector, a pair of fixed photosensors are arranged, and a light shielding plate is provided to a diaphragm to be capable of shielding the optical path, thereby detecting its deviation.

However, in the ink-jet printer having the open-air type apparatus described above, an ink tank must be arranged above the level of the ink presence/absence detectors 200*a* and 200*b*. Therefore, the total height of the printer must be inevitably increased, and the printer becomes bulky. When a decrease in ink is detected and an old ink tank is exchanged with a new one, a very long period is required for recovering a liquid level I in the manometer 200. In consideration of an inoperative state or transportation of the ink-jet printer, an opening/closing means for preventing an ink leakage from the manometer and evaporation of ink causing an increase in ink viscosity or ink solidification must be provided. Therefore, the printer becomes bulky, and its manufacturing cost is also increased.

In the closed type residual ink quantity detecting apparatus, for example, in the apparatus having the diaphragm which is partially constituted by a flexible member and detects a residual quantity of ink utilizing a deformation caused by a pressure difference between inside and outside the flexible member, as shown in FIG. 2, a detection output varies due to variations in dimension of the flexible member. Thus, the residual quantity of ink cannot be accurately detected. Since a deformation due to pressure is utilized, adjustment in the overall ink supply system, for example, adjustment of a relative level difference between the recording head and the residual ink quantity detecting apparatus, must be performed for individual ink-jet printers. Since an adjusting mechanism is arranged, the overall apparatus becomes large, and its manufacturing cost is increased.

In the ink-jet printer having the closed type residual ink quantity detecting apparatus, when an old ink tank is exchanged with a new one upon detection of decrease in ink, a very long period of time is required for recovering an initial state of the diaphragm. If a spring member having a large spring constant is used to allow quick recovery, a deviation amount of the diaphragm cannot be set to be large, and detection precision is degraded.

In the ink-jet printer having the closed type residual ink quantity detecting apparatus, the diaphragm arranged as part of the ink supply system must be deviated with good response at very low pressure of a several tens of $mmH_2O$ at which a degradation of print quality occurs. Therefore, the diaphragm is preferably formed of a material such as a low-hardness rubber having a high flexibility. In addition, its film thickness is preferably decreased to 0.1 to 0.3 mm.

For this reason, ink in the ink supply system may be evaporated through the diaphragm 301 or air enters the ink supply system therethrough, thereby: interfering with ink injection. When the print quality is degraded, a high pressure is applied to ink in the head to perform recovery. In this case, since this pressure is also applied to the diaphragm through the ink supply tube, the residual ink quantity detecting apparatus may be broken.

In the residual ink quantity detecting apparatus which is operated upon change in pressure in the ink supply system, the predetermined negative pressure, i.e., an operating pressure for the residual ink quantity detecting apparatus is very low. Therefore, the residual ink quantity detecting apparatus may be erroneously operated when a change in pressure due to a factor other than the negative pressure produced upon decrease in quantity of ink occurs.

It was found that, in a liquid injection recording apparatus shown in FIG. 3, to which the present invention is applied, the residual ink quantity detecting apparatus was erroneously operated at negative pressure produced when ink is drawn from the distal end of a recording head 1 using a pump 9 or upon change in pressure caused by movement of ink when a carriage 2 is moved.

A change in pressure in the ink system upon movement of the carriage-2 is cause during carriage turn in which the moving direction of the carriage 2 is reversed. In the mechanism shown in FIG. 3, a negative pressure is produced in the residual ink quantity detecting apparatus at the right end (right carriage turn) and a positive pressure is produced at the left end (left carriage turn). For this reason, even though the residual quantity of ink is sufficient, the residual ink quantity detecting apparatus produces an output indicating a "small" residual quantity of ink upon use of the pump and right carriage turn. On the other hand, upon left carriage turn, the apparatus produces an output indicating a "sufficient" residual quantity of ink even if the residual quantity of ink is small.

SUMMARY OF THE INVENTION

It is an object of the present invention to provide a compact, inexpensive residual ink quantity detecting apparatus with high detection precision which requires no systematic adjustment in the overall ink-jet printer.

For this purpose, according to the present invention, a residual ink quantity detecting apparatus for detecting the residual quantity of ink in an ink supply source for supplying ink to an ink-jet printer, comprises a flexible deviation member, which is connected to an ink supply path extending from the supply source, constitutes part of the path, and can be deviated upon change in pressure in the path, an adjusting member for adjusting a deviation of the deviation member for setting a pressure value causing the deviation of the deviation member, and a detecting means for detecting the deviation of the deviation member.

It is another object of the present invention to provide a compact, inexpensive ink jet printer in which the residual quantity of ink can be detected with high precision and which can quickly recover a residual ink quantity detecting apparatus to an initial state after refill of ink so as to restart recording.

For this purpose, according to the present invention, an ink-jet printer comprises a flexible deviation member, which is connected to an ink supply path extending from the supply source, constitutes part of the path, and can be deviated upon change in pressure in the path, a detecting means for detecting a deviation of the deviation member so as to detect a decrease in or the absence of ink in an ink supply source, i.e., ink consumption, and recovery means for recovering the deviation member to a state before deviation when ink is refilled to the ink supply source upon detection.

It is still another object of the present invention to provide a stable ink-jet printer in which the residual quantity of ink can be detected with high precision and which can prevent ink in an ink supply system from being evaporated through a residual ink quantity detecting apparatus and can prevent air from entering the ink supply system therethrough, thereby preventing erroneous injection.

It is still another object of the present invention to provide an ink-jet printer in which a residual ink quantity detecting apparatus can be reliably protected from a high pressure produced upon injection recovery operation of a head.

For this purpose, according to the present invention, an ink-jet printer comprises a branch path branching from an ink supply system extending from an ink supply source, an opening/closing means capable of opening/closing the branch path, a flexible deviation member which is connected to the branch path and can be deviated upon change in pressure in the ink supply system, and a residual ink quantity detecting means for detecting the deviation of the deviation member so as to detect ink consumption in the ink supply source.

Furthermore, according to the present invention, a recording apparatus having means for performing recording onto a recording medium with ink and a supply system for supplying ink, comprises a residual ink quantity-detecting means for detecting the presence/absence of ink, a holding means for holding a residual quantity detection signal from the residual ink quantity detecting means, an erroneous operation detecting means for detecting an erroneous operation of the residual ink quantity detecting means, and for, when the erroneous operation is detected, instructing holding of the residual quantity detection signal to the holding means after the erroneous operation is completed, and an alarm means for producing an alarm in accordance with the residual quantity detection signal.

It is still another object of the present invention to provide a recording apparatus capable of producing an alarm for a residual ink quantity detecting apparatus.

In order to achieve the above object, according to the present invention, a recording apparatus having means for performing recording onto a recording medium with ink and a supply system for supplying ink, comprises a residual ink quantity detecting means for detecting the presence/absence of the residual quantity of ink, an erroneous operation detecting means for detecting an erroneous operation of the residual ink quantity detecting means, an alarm signal output means for producing an alarm signal based on the residual ink quantity detection signal from the residual ink quantity detecting means and the erroneous operation detection signal from the erroneous operation detecting means, and means for determining in accordance with a signal produced upon operation of the recording apparatus whether or not the erroneous operation detection signal from the erroneous operation detecting means is supplied to the alarm signal output means.

Furthermore, according to the present invention, a recording apparatus for performing recording onto a recording medium with ink, comprises a residual ink quantity detecting means for detecting the presence/absence of ink, means for judging from a detection output pattern whether the detection output from the residual ink quantity detecting means is to be adopted, and alarm means for producing an alarm in accordance with an output signal from the judging means.

DETAILED DESCRIPTION OF THE PREFERRED EMBODIMENTS

An embodiment of the present invention will now be described with reference to the accompanying drawings.

Figure 1:
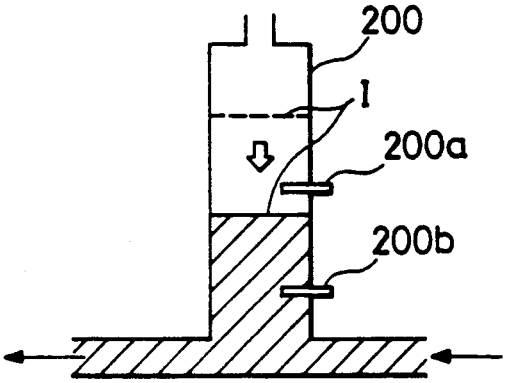
FIG. 1 PRIOR ART
FIGS. 1 and 2 are sectional views showing two types of conventional residual ink quantity detecting apparatuses in an ink-jet printer.
Figure 2:
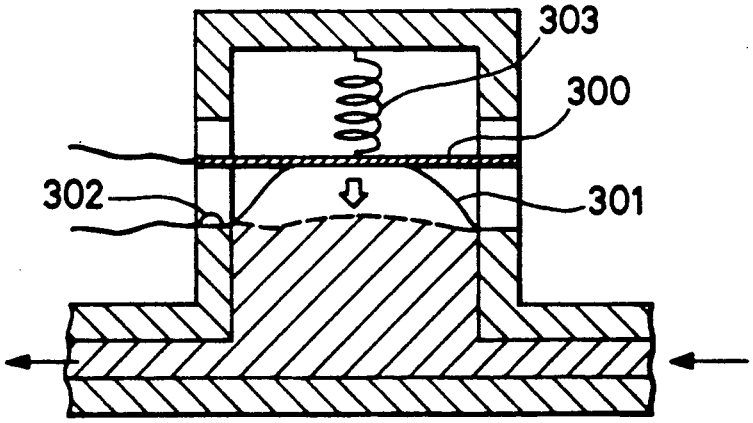
FIG. 2 PRIOR ART
Figure 3:
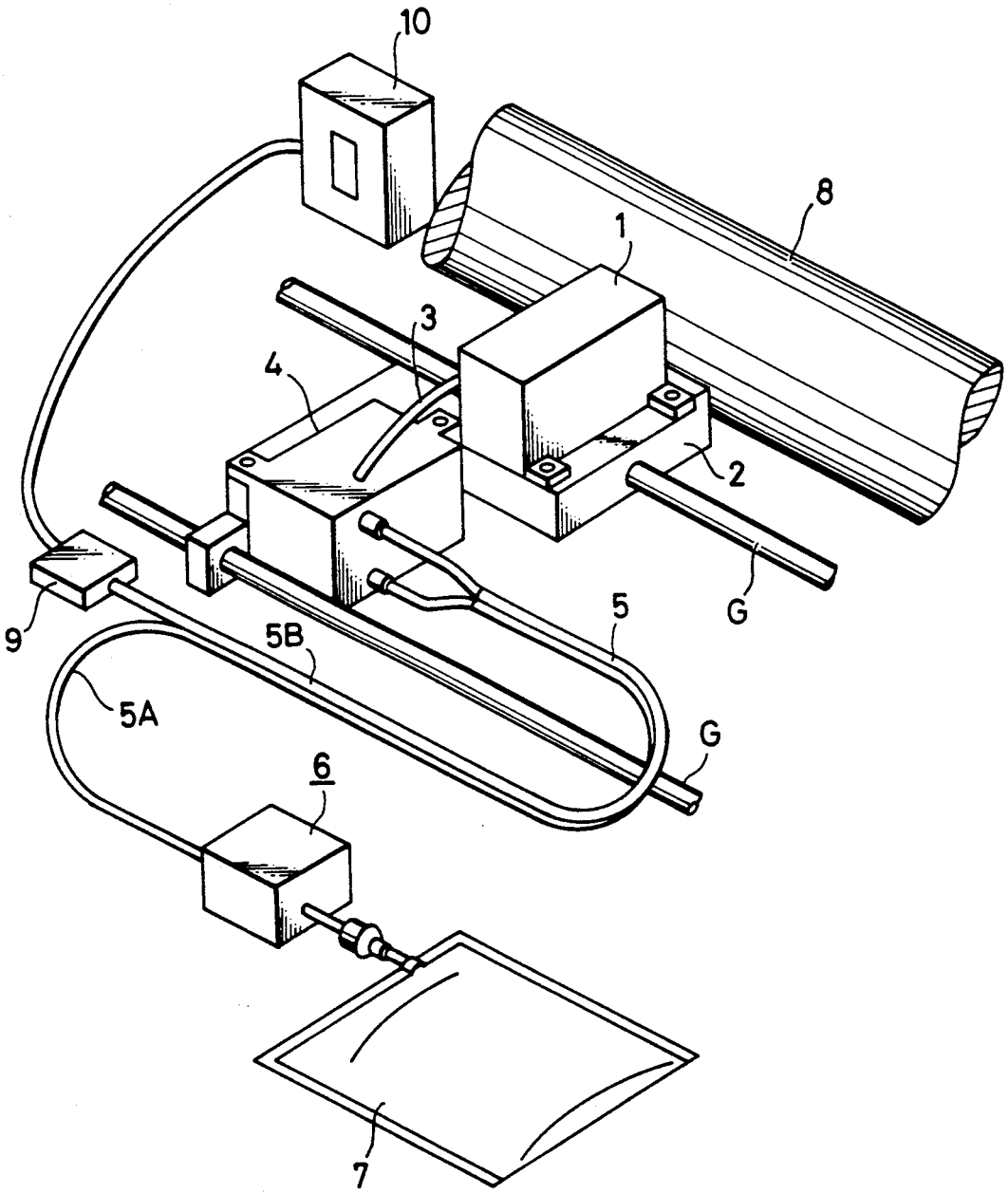
FIG. 3 is a perspective view schematically showing the arrangement of an ink-jet printer to which a residual ink quantity detecting apparatus of the present invention can be applied.

FIG. 3 shows the main part of an ink-jet recording apparatus to which the present invention is applied.

In FIG. 3, a recording head 1 ejects ink droplets to a recording medium whose recording surface is defined by a platen 8. The recording head 1 is mounted on a carriage 2, which is movable along a guide G extending in the axial direction of the platen 8. A sub-ink tank 4 is also mounted on the carriage 2. Ink stored in the sub-ink tank 4 is supplied to the recording head 1 through a supply tube 3. A flexible communicating member 5 couples a supply tube 5A for supplying ink to the sub-ink tank 4, and a pump 9, so as to maintain the quantity of ink inside the sub-ink tank 4. The pump 9 communicates with a capping device 10 and draws ink from the distal end of the recording head 1 upon print error or exchange of an ink tank 7. The ink tank 7 serves as an ink supply source. In FIG. 3, the ink tank 7 is a flat, soft, flexible bag formed of a plastic, aluminum, or the like. A residual ink quantity detecting apparatus 6 is arranged midway along the supply tube 5A, and communicates with the ink tank 7.

With the above arrangement, ink stored in the ink tank 7 is supplied to the sub-ink tank 4 mounted on the carriage 2 through the residual ink quantity detecting apparatus 6 and the supply tube 5A. The ink is then supplied from the sub-ink tank 4 to the recording head 1 mounted on the carriage 2 through the supply tube 3, and is then ejected onto the recording medium on the platen 8, thereby performing a recording operation.

Figure 4:
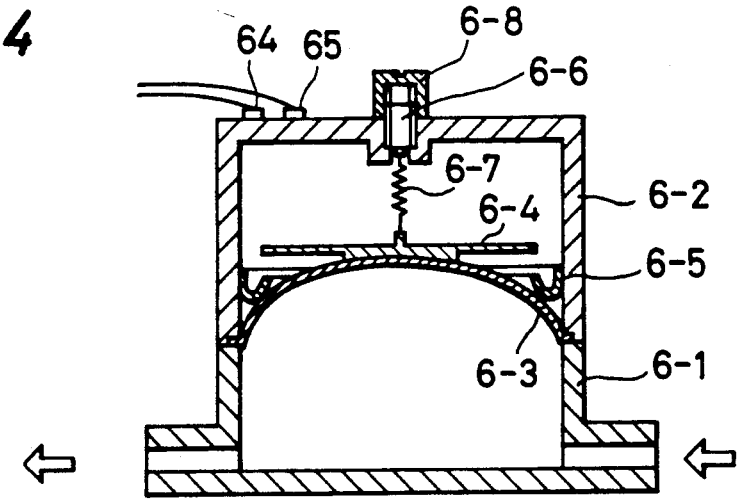
FIG. 4 is a sectional view of a residual ink quantity detecting apparatus according to an embodiment of the present invention.

FIG. 4 shows a first embodiment of the residual ink quantity detecting apparatus 6 according to the present invention. In FIG. 4, a casing 6-1 and a cover 6-2 are bonded to each other by adhesion, welding, or screws. A diaphragm 6-3 formed of a flexible member partitions a space defined by the casing 6-1 and the cover 6-2. The diaphragm 6-3 is supported by the bonded portion between the casing 6-1 and the cover 6-2 so that the space partitioned by the diaphragm 6-3 on the side of the casing 6-1 can be sealed from outer air. An electrode 6-4 formed of a conductive member is adhered to the upper portion of the diaphragm 6-3, and an electrode 6-5 is fixed to the cover 6-2 at a position opposite to the electrode 6-4.

A male screw 6-6 is arranged on the upper portion of the cover 6-2 to be vertically movable. A spring 6-7 is arranged between the male screw 6-6 and the electrode 6-4, thereby biasing the electrode 6-4 upward in FIG. 4. An adjusting screw 6-8 in which a female screw having the same diameter and pitch as those of the male screw 6-6 is threaded is arranged on the upper portion of the cover 6-2 and is engaged with the male screw 6-6. Terminals 64 and 65 are connected to the electrodes 6-4 and 6-5, respectively. The terminals 64 and 65 can be connected to an alarm means for producing a sound or performing indication or light emission with or without being connected through a control circuit and the like.

With the above arrangement, when the quantity of ink in the sealed ink tank 7 which is at least partially constituted by a flexible member is decreased, and a recording operation is continuously performed, a negative pressure in an ink system path as a whole indicated by arrows in FIG. 4 is gradually increased. In response to this, the flexible diaphragm 6-3 in the residual ink quantity detecting apparatus 6 is moved downward against the biasing force. Thus, when a predetermined negative pressure is reached, the electrodes 6-4 and 6-5 are brought into contact with each other. A signal indicating contact is supplied to a control circuit and the like through the terminals 64 and 65 connected to the electrodes 6-4 and 6-5, respectively. In this manner, an operator can know that the residual quantity of ink in the ink tank 7 is small by means of a sound or light.

The predetermined negative pressure at which the electrodes 6-4 and 6-5 are brought into contact with each other is preferably set at a value before a recording quality by the ink-jet printer is degraded. The negative pressure value is normally very small. Therefore, it is difficult to accurately detect the negative pressure due to variations in dimension of the diaphragm 6-3, variations in spring constant of a raw material, and the like. Therefore, in the first embodiment, the distance between the electrodes 6-4 and 6-5 can be changed by turning the adjusting screw 6-8, so that the spring constant of the flexible diaphragm 6-3 is virtually changed.

Figure 5:
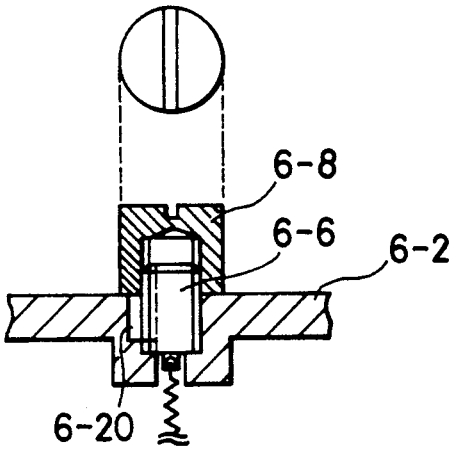
FIG. 5 illustrates a plan view and a front view showing a detailed arrangement of a detected negative pressure adjusting portion of the embodiment shown in FIG. 4.

FIG. 5 shows an adjusting portion in detail. In FIG. 5, a key 6-20 is arranged on the cover 6-2, and is coupled to a key groove formed in the male screw 6-6 so as to prevent rotation of the male screw 6-6 and to allow vertical deviation thereof. Thus, even if the adjusting-screw 6-8 is turned since the rotation of the male screw 6-6 is prevented by the key groove, the distance between the electrodes 6-4 and 6-5 can be adjusted without twisting the spring 6-7 and the flexible diaphragm 6-3. The spring constant of the spring 6-7 is determined by the negative pressure and the spring constant of the flexible diaphragm 6-3. Therefore, the present invention is not limited to the spring 6-7 but can be an elastic member having the same spring constant.

Figure 6:
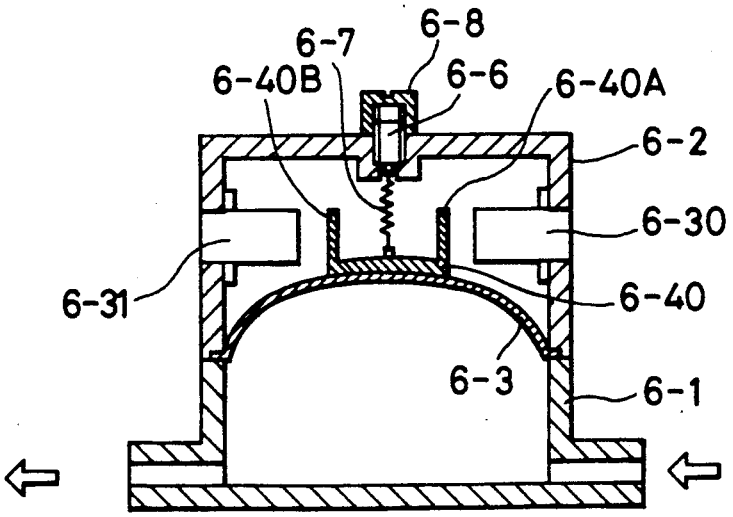
FIG. 6 is a sectional view showing another embodiment of the present invention.

FIG. 6 shows a second embodiment of the present invention. The same reference numerals in FIG. 6 denote the same parts as in the first embodiment shown in FIG. 4.

In FIG. 6, a light emitting member 6-30 and a light receiving member 6-31 are arranged on the cover 6-2. A light shielding member 6-40 is arranged on the flexible diaphragm 6-3 and has light shielding plates 6-40A and 6-40B arranged along the optical axis between the members 6-30 and 6-31.

With this arrangement, a negative pressure is generated in the supply path, and the diaphragm 6-3 is moved downward to prevent a light shielding operation of the light shielding member 6-40. Thus, when the light receiving member 6-31 receives light emitted from the light emitting member 6-30, the light receiving signal is detected by a control circuit and the like, and a similar alarm as above can be performed. Adjustment of the negative pressure can be performed in the same manner as in the first embodiment shown in FIG. 4.

Figure 7:
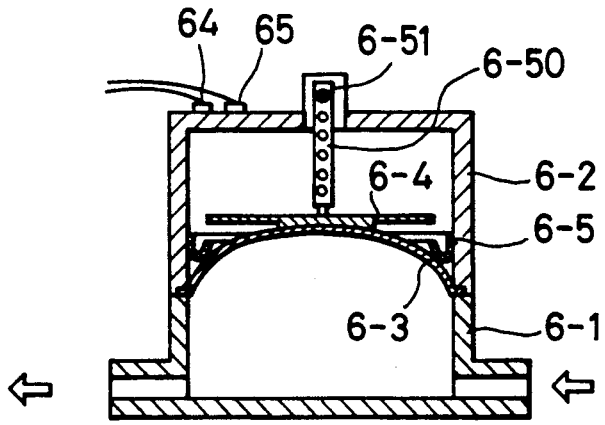
FIG. 7 is a sectional view showing still another embodiment of the present invention.

FIG. 7 shows a third embodiment of the present invention. The same reference numerals in FIG. 7 denote the same parts as in FIG. 4. In FIG. 4, an elastic member 6-50 has a proper number of holes at a proper pitch P. An adjusting portion 6-51 has a screw for coupling the elastic member 6-50 and the cover 6-2.

Figure 8A:
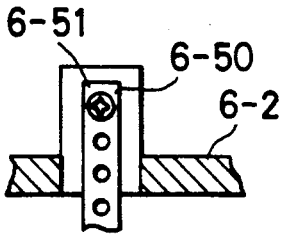
FIGS. 8A and 8B are a front view and a side view showing a detailed arrangement of a detected negative pressure adjusting portion of the embodiment shown in FIG. 7.
Figure 8B:
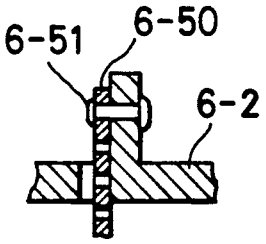

FIGS. 8A and 8B show the detailed arrangement of the adjusting portion shown in FIG. 7. FIG. 8A is a front view and FIG. 8B is a side view.

In the third embodiment, the flexible diaphragm 6-3 is suspended by the elastic member 6-50. The fixing position of the elastic member 6-50 is changed so that the flexible diaphragm 6-3 is deformed by a predetermined amount at a predetermined negative pressure, thereby obtaining the same effect as in the embodiment shown in FIG. 4.

The adjusting portion according to the third embodiment can be effectively and easily applied to the embodiment shown in FIG. 6.

According to the first to third embodiments described above, the residual quantity of ink can be detected at a properly adjusted negative pressure. Therefore, a detecting portion need not be dipped in ink, and hence, the detection reliability can be improved.

Since the detected negative pressure adjusting portion is provided to the residual ink quantity detecting apparatus, adjustment need not be performed in the ink-jet printer as a whole for residual ink quantity detection. In addition, a detected residual quantity adjusting portion need not always be arranged in the printer. Therefore, a compact, inexpensive, and highly precise residual ink quantity detecting apparatus can be realized.

Since the residual ink quantity detecting apparatus is independent of the ink tank, the apparatus can be continuously used even when the ink tank is exchanged. Therefore, the ink tank can be prepared with low cost.

The above embodiments are not limited to the ink-jet printer shown in FIG. 3 but can be applied to an ink-jet printer having a so-called full-multi type recording head in which ejection orifices are aligned over the total width of the recording medium.

As described above, according to the first to third embodiments, adjustment need not be performed in a system of the overall ink-jet printer, but easy adjustment is allowed. An inexpensive printer can be provided without increasing its size, and a residual ink quantity detecting apparatus with high detection precision can be realized.

Figure 9:
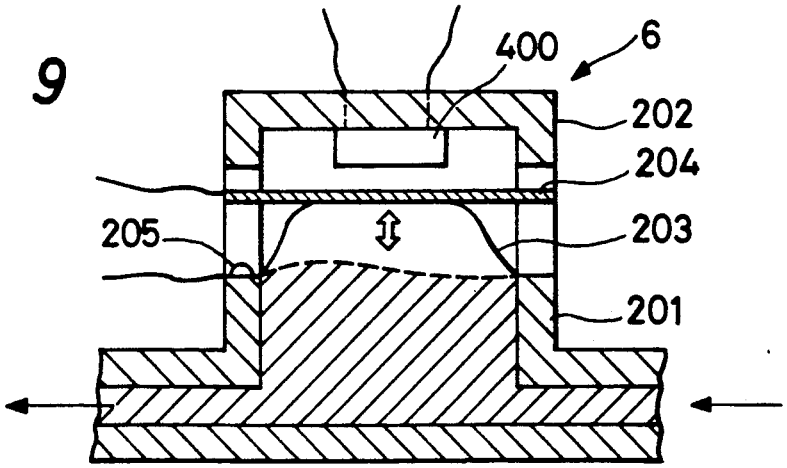
FIG. 9 is a sectional view of a residual ink quantity detecting apparatus according to still another embodiment of the present invention.

FIG. 9 shows a fourth embodiment of the residual ink quantity detecting apparatus. A casing 201 and a cover 202 are bonded to each other by adhesion, welding or screws. A diaphragm 203 is at least partially constituted by a flexible member such as an aluminum laminated film, rubber, or the like, and partitions a space defined by the casing 201 and the cover 202. The diaphragm 203 is supported by the bonding portion between the casing 201 and the cover 202 so that the space partitioned by the diaphragm 203 on the side of the casing 201 can be completely sealed from outer air. An electrode 204 having conductivity and magnetism is bonded to the upper portion of the diaphragm 203 by adhesion. An electrode 205 is fixed to the cover 202 at a position capable of being in contact with the electrode 204. A magnet 400 is arranged to face the electrode 204.

With the above arrangement, when the quantity of ink in the sealed ink tank 7 which is at least partially constituted by a flexible member is decreased, and a recording operation is continuously performed, a negative pressure in an ink system path as a whole indicated by arrows in FIG. 9 is gradually increased. In response to this, the flexible diaphragm 203 in the residual ink quantity detecting apparatus 6 is collapsed and moved downward. Thus, when a predetermined negative pressure is reached, the electrodes 204 and 205 are brought into contact with each other. A signal indicating contact is supplied to a control unit shown in FIG. 12. In this manner, an operator can know that the residual quantity of ink in the ink tank 7 is small by means of a sound or light.

The predetermined negative pressure causing the electrodes 204 and 205 to be in contact with each other is preferably set at a value before a recording quality by the ink-jet printer is degraded. This value can be determined by the rigidity of the flexible diaphragm 203 and the distance between the electrodes.

After a decrease in or the absence of ink is detected, an old ink tank is exchanged with a new one. When exchange of the ink tank is detected by a microswitch and the like, the magnet 400 is energized in response a detection signal, as will be described later, so that the magnet 400 is forcibly moved upward, thereby recovering an initial state (a state for detecting the presence of ink in the ink tank).

Figure 10:
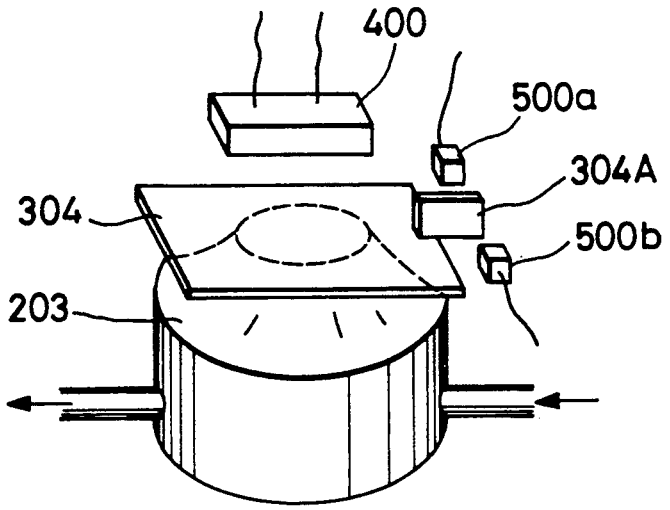
FIG. 10 is a perspective view showing still another embodiment of the present invention.

FIG. 10 shows a fifth embodiment of the residual ink quantity detecting apparatus 6. In this embodiment, a pair of photosensors 500*a* and 500*b* are stationally arranged, and a member 304 having a light shielding plate 304A capable of shielding the optical path is arranged on the flexible diaphragm 203. Other arrangements and the operation of this embodiment are the same as those in the fourth embodiment shown in FIG. 9.

According to the fifth embodiment, the residual quantity of ink can be detected in a noncontact manner, thus still improving the reliability.

Figure 11:
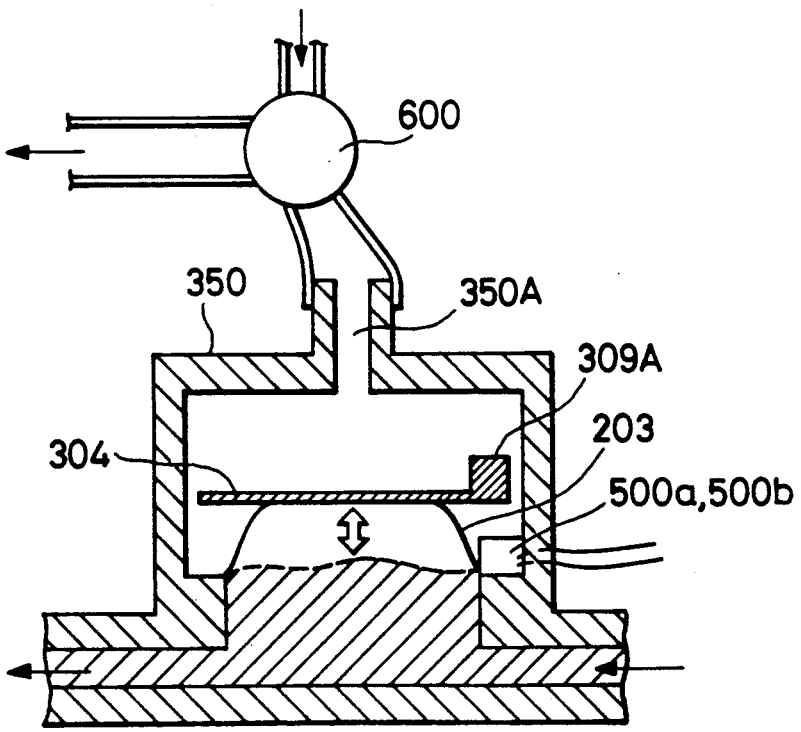
FIG. 11 is a sectional view showing still another embodiment of the present invention.

FIG. 11 shows a sixth embodiment of the residual ink quantity detecting apparatus. In the sixth embodiment, the member 304 and the photosensors 500*a* and 500*b* are arranged in a cover 350 which is sealed except an upper opening 350A, and the upper opening 350A is connected to a three way valve 600. Of other two openings of the valve 600, one communicates with air, and other one is connected to a suction means, e.g., a pump for recovering ejection of the recording head 1.

With the above arrangement, the valve 600 normally communicates with air, so that the flexible diaphragm 203 is easily collapsed. Upon exchange of the ink tank after a decrease in or the absence of ink is detected, the opening communicating with air of the valve 600 is closed, and the opening connected to the suction means is opened. Suction is then performed from the interior of the cover 350 to set a negative pressure state, thereby forcibly recovering the flexible diaphragm 203.

The sixth embodiment can be easily applied to an apparatus which detects a residual quantity by means of electrodes like in the fourth embodiment shown in FIG. 9.

Figure 12:
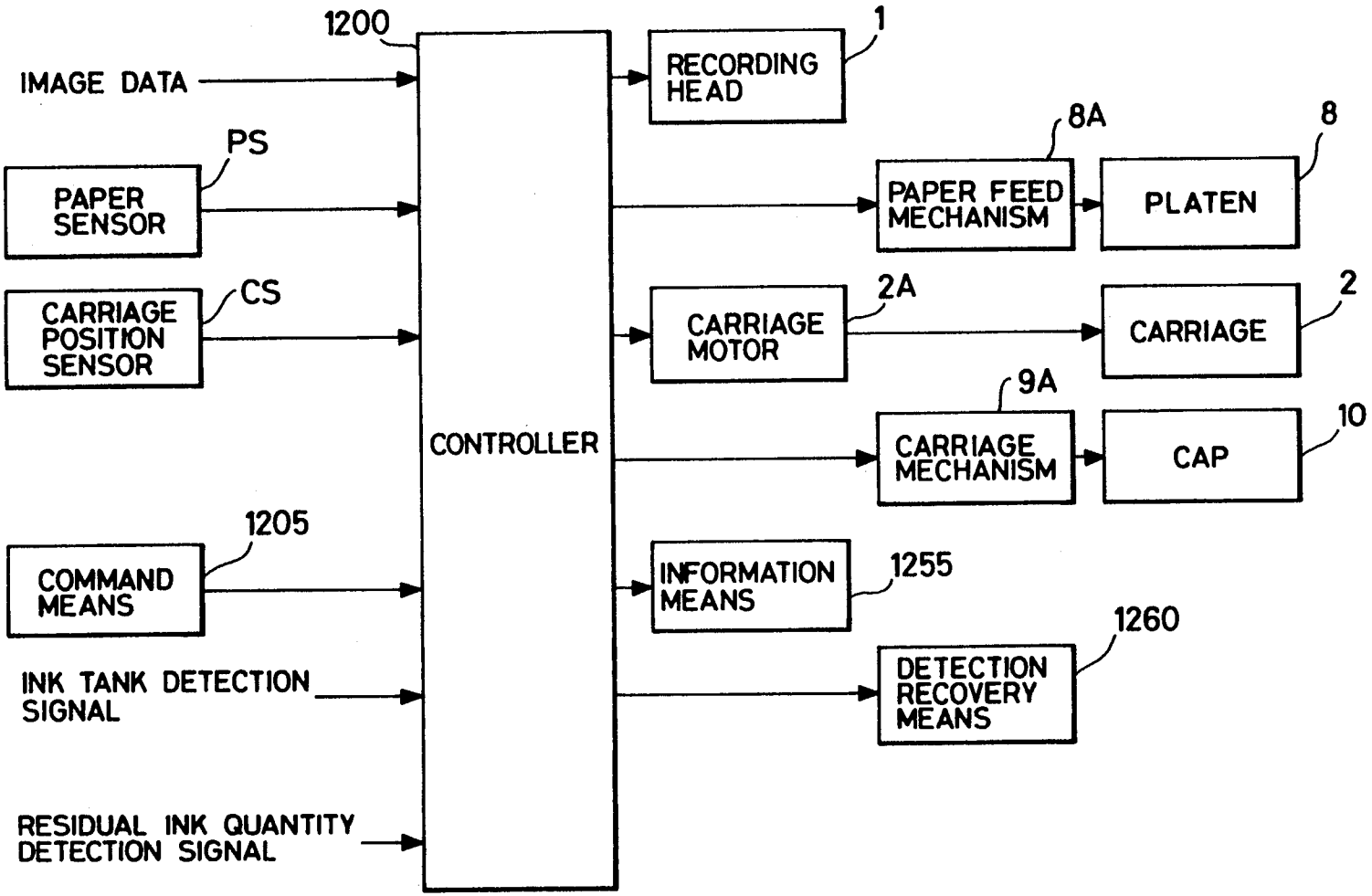
FIG. 12 is a block diagram showing the arrangement of a control system of the present invention.

FIG. 12 shows a control system of the ink-jet printer according to the present invention. The control system includes a controller 1200 such as a microcomputer having a CPU, ROM, RAM, and the like. The controller 1200 controls the respective circuit elements in accordance with the processing sequence shown in FIG. 13 stored in the ROM. The controller 1200 drives the recording head 1 in accordance with image data received from a host apparatus, thereby performing a recording operation. A paper sensor PS detects a recording paper sheet P. The controller 1200 drives the platen 8 in accordance with the detection result from the sensor PS through a paper feed mechanism 8A including a paper feed motor, thereby controlling a paper feed operation. The controller 1200 controls the drive operation or positioning operation to the home position of the carriage 2 through a carriage motor 2A in accordance with position data detected by a carriage position sensor CS.

A conveying mechanism 9A has a transmission mechanism such as gears, cams, and the like and a drive member such as a motor, and conveys the capping 10 in a direction C in FIG. 3. A command means 1205 and an information means 1255 are arranged on an operation panel (not shown), and each have keys for instructing the start of recording, an a display for displaying a message for urging an operator to exchange the ink tank or a buzzer.

A detection recovery means 1260 causes the residual ink quantity detecting apparatus to be recovered to an initial state. In the fourth and fifth embodiments shown in FIGS. 9 and 10, the means 1260 corresponds to the magnet, and in the sixth embodiment shown in FIG. 11, it corresponds to the three way valve 600 and the suction means such as a pump. In the latter case, the suction means can also serve as a suction means, coupled to the capping 10, for recovering ejection.

In the fourth embodiment shown in FIG. 9, the residual quantity detection signal corresponds to a signal produced upon contact of the electrodes 204 and 205, and in the fifth and sixth embodiments shown in FIGS. 10 and 11, it corresponds to the detection signal of the light shielding plate 304A by the photosensors sensors 500*a* and 500*b*. An ink tank detection signal can be obtained from a limit switch which is arranged near a mounting position of the ink tank 7 in order to detect the presence/absence or exchange of the ink tank 7.

Figure 13:
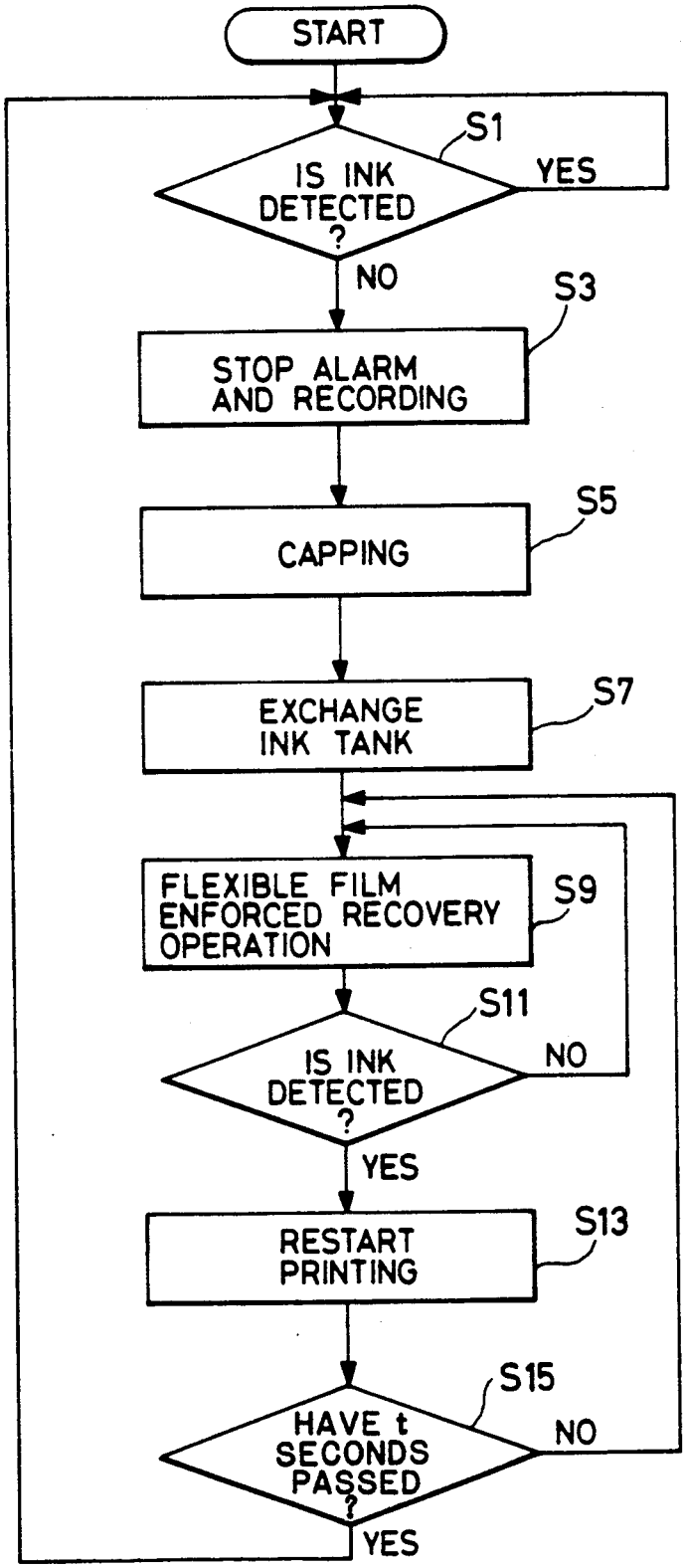
FIG. 13 is a flow chart showing a processing sequence of the present invention.

FIG. 13 shows the processing sequence when the residual quantity of ink in the ink tank 7 becomes small or the ink is used up. When a signal indicating that no ink is detected is supplied from the residual ink quantity detecting apparatus in step S1, an alarm is produced to an operator so as to urge him to exchange the ink tank by means of display or sound of the information means 1255 and the recording processing is stopped in step S3. In step S5, the carriage 2 is returned to the home position, and the capping device 10 is coupled to the recording head 1, thus awaiting exchange of the ink tank by the operator.

If exchange of the ink tank 7 is detected by, e.g., a microswitch arranged at the ink tank mounting position in step S7, the ink detection recovery means 1260 is driven in step S9, so that the flexible diaphragm 203 is forcibly recovered to the initial state. This operation is repeated until ink is detected in step S11. If the ink is detected in step S11, the flow advances to step S13, and a recording restart command is output. In step S15, the driving state of the ink detection recovery means 1260 is maintained for a predetermined time t (sec). The predetermined time t corresponds to a time required for recovering the negative pressure state caused by the forcible recovery processing to a state balanced with air. For example, this time can be experimentally determined in consideration of the specifications of the apparatus.

With the residual ink quantity detecting apparatus according to the embodiments described above, when the ink tank is exchanged with a new one, the apparatus is forcibly recovered to the initial state. Therefore, poor recovery response of the residual ink quantity detecting apparatus as the serious problem of the conventional ink-jet printer can be perfectly eliminated.

The present invention is not limited to the ink-jet printer shown in FIG. 3, but can be applied to an ink-jet printer having a full-multi type recording head in which ejection orifices are aligned over the total width of the recording medium. In the above embodiments, an ink tank of a detachable cartridge type is adopted. However, a fixed ink tank can be adopted, and ink can be refilled to the tank by injection.

According to the first to sixth embodiments as described above, a reliable, compact, and inexpensive ink-jet printer which will not cause an erroneous operation associated with the residual ink quantity detecting apparatus, and which can quickly recover the initial state after ink is refilled can be realized.

Figure 14:
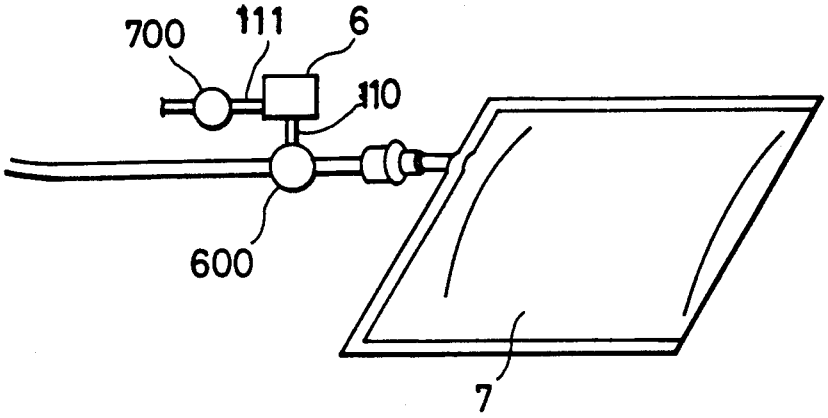
FIG. 14 is a perspective view schematically showing a residual ink quantity detecting apparatus according to a seventh embodiment of the present invention.

In still another embodiment (seventh embodiment) of the present invention, the residual ink quantity detecting apparatus is arranged as shown in FIG. 14. In FIG. 14, a three way opening/closing valve 600 is connected to the residual ink quantity detecting apparatus 6 through a branched path 110 of the supply system. The apparatus 6 is connected to an open-air portion 111 having a valve 700. The three way valve 600, the valve 700, and the apparatus 6 are coupled to a controller which will be described later with reference to FIG. 16.

Figure 15:
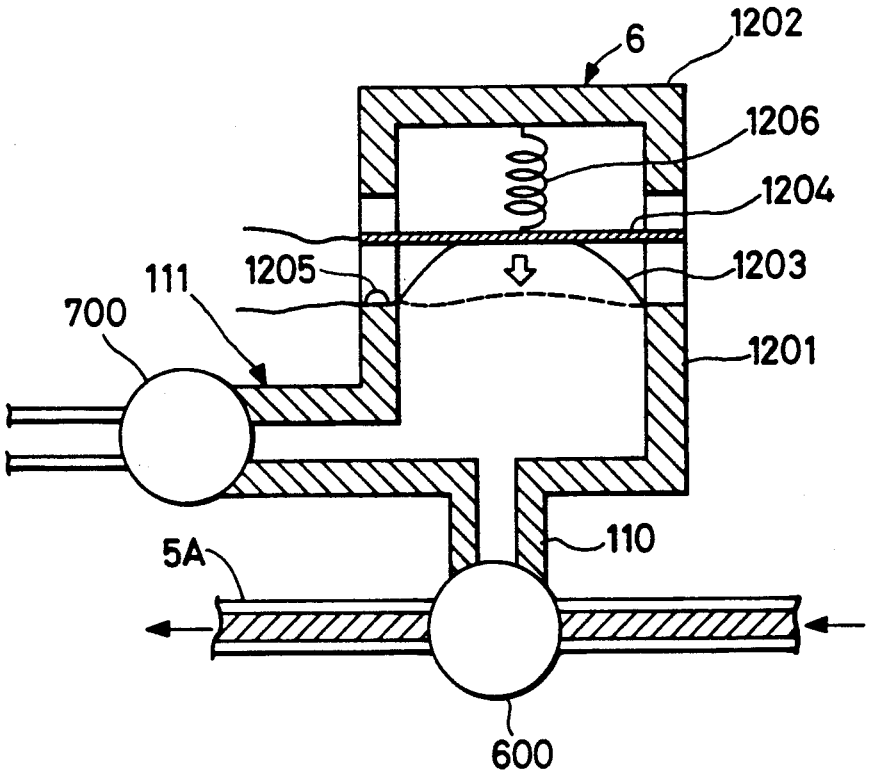
FIG. 15 is a sectional view of the residual ink quantity detecting apparatus of the seventh embodiment of the present invention.

FIG. 15 shows a seventh embodiment of the residual ink quantity detecting apparatus shown in FIG. 14. A casing 1201 and a cover 1202 are bonded to each other by adhesion, welding or screws. A diaphragm 1203 is at least partially constituted by a flexible member such as rubber, or the like, and partitions a space defined by the casing 1201 and the cover 1202. The diaphragm 1203 is supported by the bonding portion between the casing 1201 and the cover 1202 so that the internal space partitioned by the diaphragm 1203 on the side of the casing 1201 can be completely sealed from outer air. An electrode 1204 having conductivity and magnetism is bonded to the upper portion of the diaphragm 1203 by adhesion. An electrode 1205 is fixed to the cover 1202 at a position capable of being in contact with the electrode 1204.

With the above arrangement, when the quantity of ink in the sealed ink tank 7 which is at least partially constituted by a flexible member is decreased, and a recording operation is continuously performed, a negative pressure in an ink system path as a whole indicated by left arrows in FIG. 15 is gradually increased. When the three way valve 600 is opened in three ways in response to this, the flexible diaphragm 1203 in the residual ink quantity detecting apparatus 6 is depressed and moved downward. Thus, when a predetermined negative pressure is reached, the electrodes 1204 and 1205 are brought into contact with each other. A signal indicating contact is supplied to a controller shown in FIG. 16. In this manner, an operator can know that the residual quantity of ink in the ink tank 7 is small by means of sound or light.

The predetermined negative pressure causing the electrodes 1204 and 1205 to be in contact with each other is preferably set at a value before a recording quality by the ink-jet printer is degraded. This value can be determined by the rigidity of the flexible member 1203, the spring constant of the spring 1206, and the distance between the electrodes.

The valve 700 provided to the open-air portion 111 is closed during the residual ink quantity detection. In other cases, the valve 700 is opened/closed in response to a signal from the controller shown in FIG. 16, and eliminates variations in pressure produced in the residual ink quantity detecting apparatus 6.

Note that residual ink quantity detection can be performed not only by the electrodes as above but by photosensors, and the like.

Figure 16:
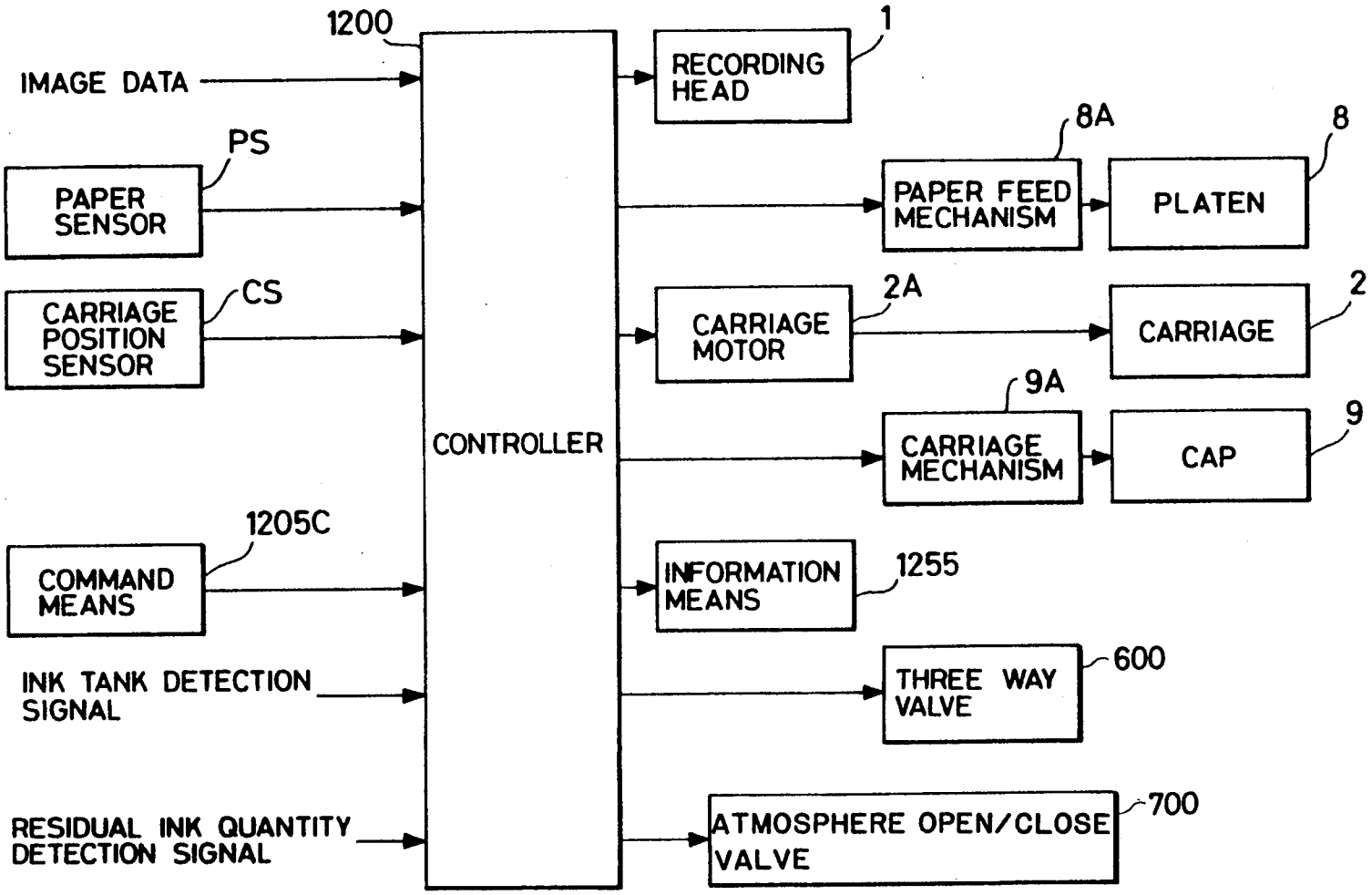
FIG. 16 is a block diagram showing a control system in the seventh embodiment of the present invention.

FIG. 16 shows-a-control system of the ink-jet printer according to the seventh embodiment of the present invention. The same reference numerals in FIG. 16 denote the same parts as in FIG. 12. The control system includes a controller 1200 such as a microcomputer having a CPU, ROM, RAM, and the like. The controller 1200 controls the respective circuit elements in accordance with the processing sequence shown in FIG. 17 stored in the ROM. The controller 1200 drives the recording head 1 in accordance with image data received from a host apparatus, thereby performing a recording operation. A paper sensor PS detects a recording paper sheet P. The controller 1200 drives the platen 8 in accordance with the detection result from the sensor PS through a paper feed mechanism 8A including a paper feed motor, thereby controlling a paper feed operation. The controller 1200 controls the drive operation or positioning operation to the home position of the carriage 2 through a carriage motor 2A in accordance with position data detected by a carriage position sensor CS.

A conveying mechanism 9A has a transmission mechanism such as gears, cams, and the like and a drive member such as a motor and conveys the capping 9 in a direction C in FIG. 3. A command means 1205C and an information means 1255 are arranged on an operation panel (not shown), and each have keys for instructing the start-of-recording, and a display for displaying a-message for urging an operator to exchange the ink tank or a buzzer. The valves 600 and 700 are opened/closed in accordance with the processing sequence shown in FIG. 17.

A residual quantity detection signal can be obtained by a signal produced upon contact of the electrodes 1204 and 1205 in the seventh embodiment shown in FIG. 15.

An ink tank detection signal can be obtained from, e.g., a limit switch arranged near a mounting position of the ink tank 7 so as to detect the presence/ absence or exchange of the ink tank 7.

Figure 17:
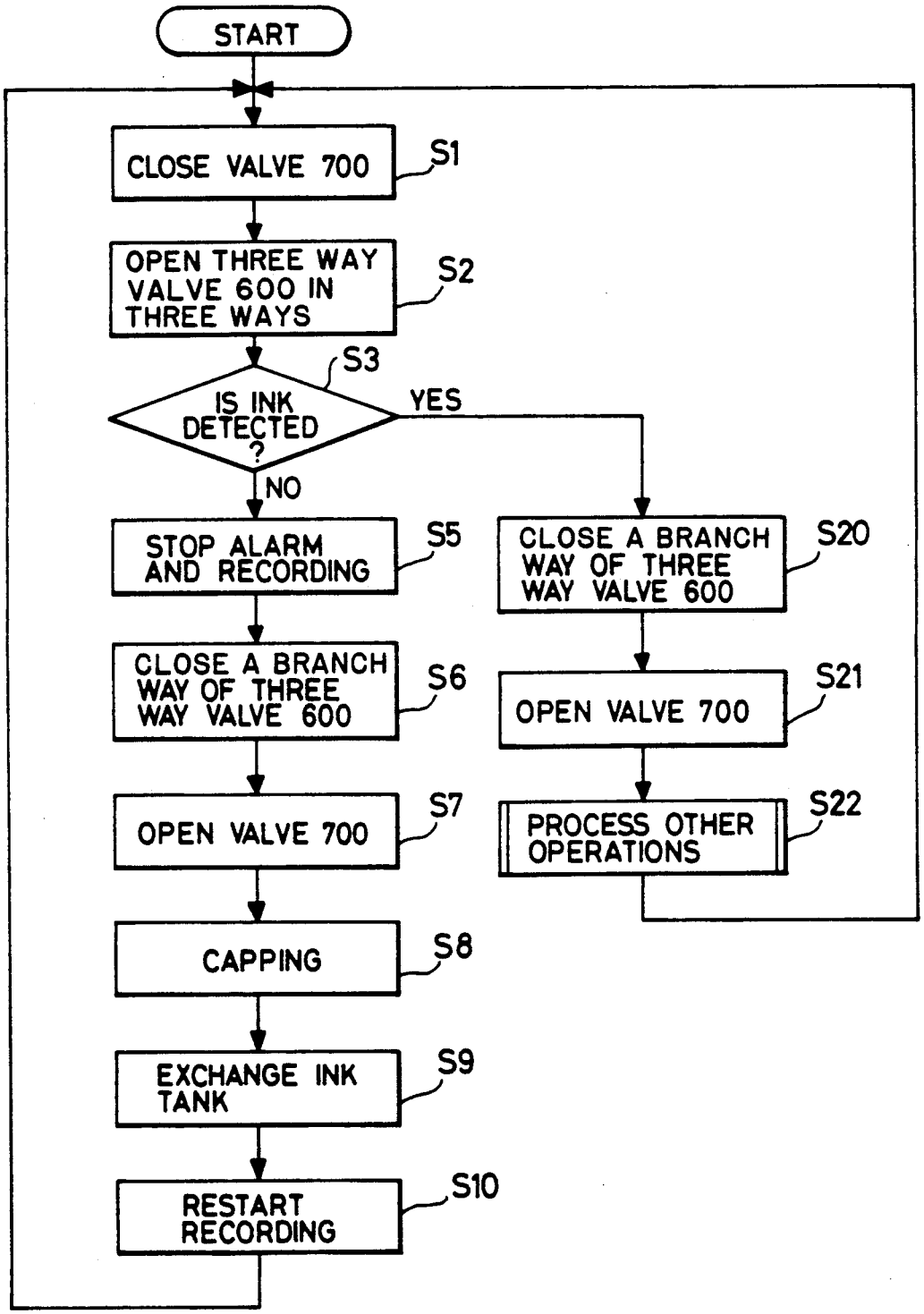
FIG. 17 is a flow chart showing a processing sequence in the seventh embodiment of the present invention.

FIG. 17 shows the processing sequence of the residual ink quantity detection in the ink tank 7. In step S1, the valve 700 in the open-air portion is closed to close the residual ink quantity detecting apparatus 6. In step S2, the three way valve 600 of the branch portion is opened in the three ways, so that the pressure in the ink supply system is transmitted to the detecting apparatus 6. If a signal indicating that no ink is detected is input from the detecting apparatus 6 in step S3, an alarm is produced to an operator so as to urge exchange of the ink tank by means of display or sound of the information means 1255 and the recording processing is stopped in step S5. In step S6, the branch way of the three way valve 600 is closed to seal the interior of the detecting apparatus 6. In step S7, the valve 700 is open to air, and the pressure inside the detecting apparatus 6 is set to be zero as a gauge pressure.

In step S8, the carriage 2 is returned to the home position, and the recording head 1 is capped by the capping 9, thus awaiting exchange of the ink tank by the operator.

If exchange of the ink tank 7 is detected by, e.g., a microswitch arranged at the ink tank mounting position in step S9, the flow advances to step S10, and a recording restart command is output, thereby enabling the recording operation.

If YES in step S3, i.e., if it is detected by the noncontact state of electrodes 1204 and 1205 of the detecting apparatus 6 that ink is present in the supply system, the flow advances to step S20, and the branch way of the three way valve 600 is closed. In step S21, the open-air valve 700 is opened, and in step S22, other operations such as recording processing, standby processing, ejection recovery processing, and the like, are performed. During the recording processing, this processing is interrupted for every predetermined period of time or every predetermined volume of recording, and the flow returns to step S1 to execute the residual quantity detection processing.

In the ejection recovery processing, the branch way of the three way valve 600 is closed and the head 1 capped by the capping 9, in the same manner as in steps S6 and S8. In this state, a suction means coupled to the capping 9 or a compression means arranged in a proper portion of the supply system, is driven, thereby forcibly discharging ink from the ink ejection hole of the head 1. Thus, clogging of the ink ejection hole can be eliminated. In this case, a pressure transmitted to the respective portions of the supply system does not reach the detecting apparatus 6, since the branch way of the three way valve 600 is closed. Therefore, the diaphragm 203 will not be broken.

In the seventh embodiment, since the branch way of the three way valve 600 is closed except in the residual ink quantity detection mode, air entering from the diaphragm constituting the residual ink quantity detecting apparatus can be prevented from entering the ink supply system. In addition, ink in the ink supply system can be prevented from being evaporated through the diaphragm. Therefore, erroneous ejection caused by the presence of the residual ink quantity detecting apparatus can be prevented.

When the three way valve 600 is appropriately controlled, even if a high pressure is applied to the supply system during the ejection recovery processing of the head, this will not reach the detecting apparatus 6. Therefore, the diaphragm 203 can be prevented from being broken, and its service life can be greatly prolonged.

Control of the three way valve 600 is effective in terms of protection of the detecting apparatus 6 from a pressure wave produced in the supply tube 5A upon movement and stop of the carriage 2, in an apparatus for performing a recording operation in accordance with a reciprocal movement of the carriage 2, as in the seventh embodiment. This is because the branch way of the three way valve 600 is closed.

Since the open-air portion 111 having the valve 700 is connected to the detecting apparatus 6 and is open to air except in the residual ink quantity detection mode, a change in pressure inside the detecting apparatus 6 due to a change in environmental conditions such as temperature or entrance of air from the diaphragm 203 can be eliminated.

The present invention is not limited to the ink-jet printer shown in FIG. 3, but can be applied to an ink-jet printer having a full-multi type recording head in which ejection orifices are aligned over the total width of the recording medium. In the above embodiments, an ink tank of a detachable cartridge type is adopted. However, a fixed ink tank can be adopted, and ink can be refilled in the tank by injection.

According to the seventh embodiment as described above, a stable ink-jet printer which can detect the residual quantity of ink with high reliability, can prevent evaporation of ink inside the ink supply system or entrance of air inside the ink supply system through the residual ink quantity detecting apparatus, and can prevent erroneous ejection, can be realized.

The residual ink quantity detecting apparatus can be reliably protected from a high pressure produced upon ejection recovery processing of the head, and its reliability can be greatly improved.

Still another embodiment of the present invention, wherein an erroneous operation of ink detection caused by variations in pressure inside an ink supply system can be prevented, will now be described.

Figure 18:
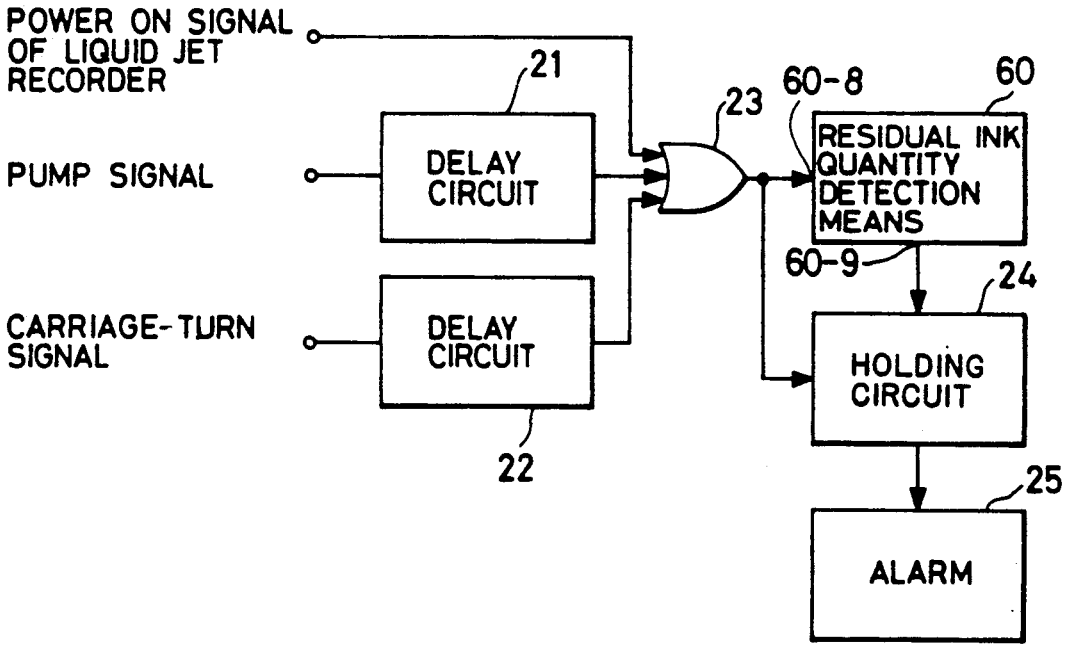
FIG. 18 is a block diagram showing a circuit arrangement in an eighth embodiment of the present invention.

FIG. 18 shows a circuit arrangement of a residual quantity detecting mechanism according to an eighth embodiment of the present invention.

In FIG. 18, a delay circuit 21 receives a pump drive start signal for driving the pump 9 to delay the output timing of this signal. A delay circuit 22 receives a carriage turn signal for causing left and right carriage turn operations of the carriage 2 to delay the output timing of this signal.

An OR gate 23 receives a power-on signal from the ink-jet printer, the pump drive start signal, and the carriage turn signal, and selectively outputs these signals when one of these signals is input. The output from the OR gate 23 is supplied to a terminal 608 of a residual ink quantity detecting means 60 and a gate input terminal of a holding circuit 24.

The holding circuit 24 serves as a latch circuit, such that it holds the residual quantity detection signal output from a terminal 60-9 of the detecting means 60 and outputs the residual quantity detection signal to an alarm device 25 when it receives a residual quantity detection command signal output from the OR gate 23.

The alarm device 25 receives the residual quantity detection signal output from the holding circuit 24, and produces an alarm sound in accordance with the content of the input signal when the residual quantity of ink becomes "small".

Figure 19:
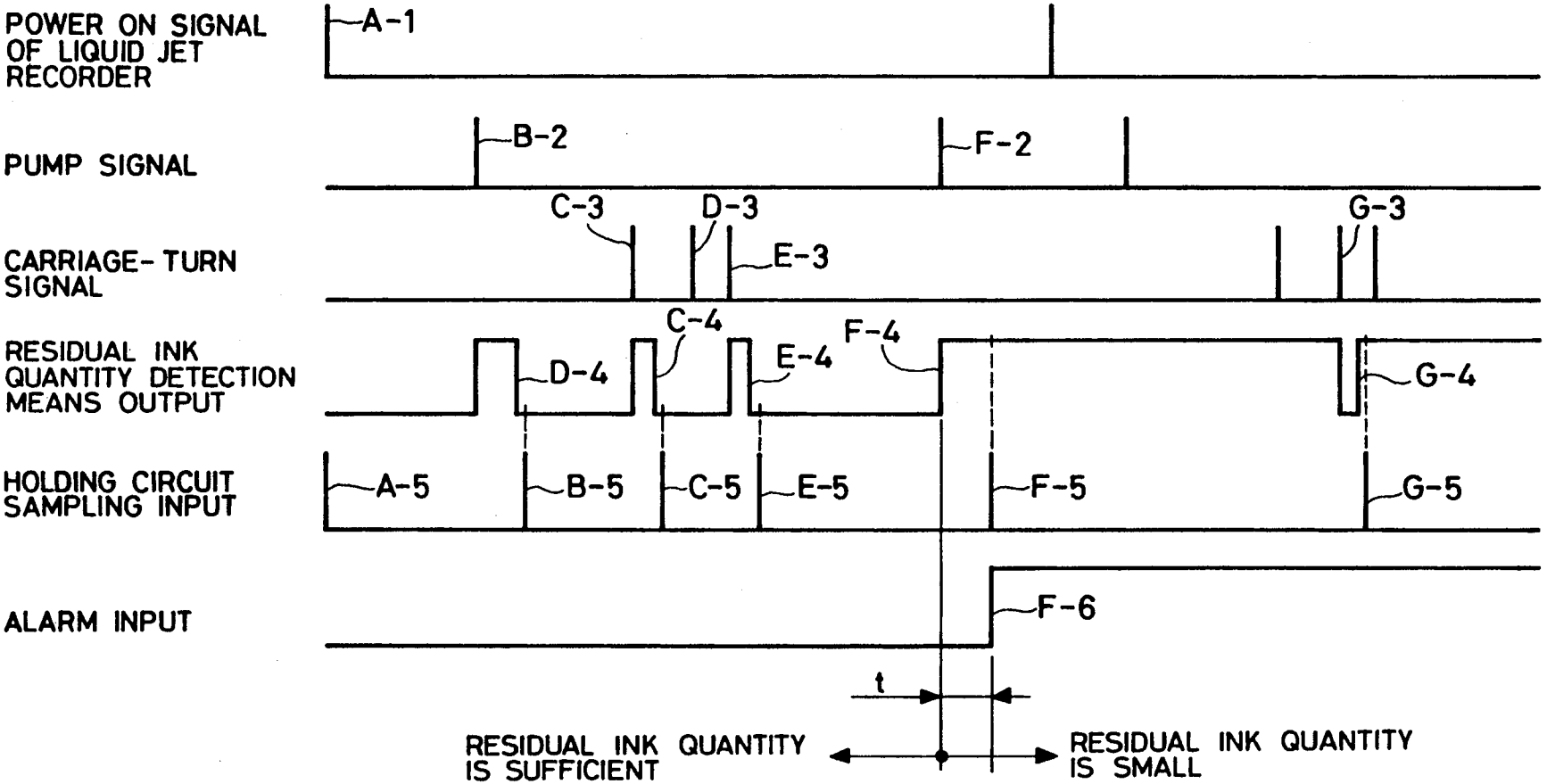
FIG. 19 is a timing chart showing signal generation timings in the eighth embodiment of the present invention.

FIG. 19 shows input/output timings of signals in the respective devices in the eighth embodiment of the present invention.

In FIG. 19, when the power source of the inkjet printer is turned on, a power-on signal A-1 is output to the residual quantity detecting means 60 and the holding circuit 24 through the OR gate 23. If the residual quantity of ink in the ink tank 7 is "sufficient", the terminals 608 and 609 of the detecting means 60 are electrically connected to each other. Therefore, the detecting means 60 outputs the input signal from the OR gate 23 to the holding circuit 24. Note that in FIG. 19, when the terminals 608 and 609 of the detecting means 60 are electrically connected to each other, a pulse signal is not generated (signal "L"), and when they are disconnected from each other, the pulse signal is produced (signal "H").

Therefore, since the holding circuit 24 receives the residual quantity detection command signal A-5 from the OR gate 23, it outputs the residual quantity detection signal "L" to the alarm device 25, and holds the output signal "L". The alarm device 25 receives the signal "L" and determines that the quantity of ink is "sufficient".

After the power source is turned on, the recording operation is started. When the pump 9 is driven during print error, a drive signal B-2 of the Z5 pump 9 is delayed by the delay circuit 21 from the pump drive timing, and is output to the detecting means 60 and the holding circuit 24 through the OR gate 23. The delay time corresponds to a time required for completing the drive operation of the pump. The detecting means 60 is erroneously operated upon drive operation of the pump 9, as described above, and outputs a signal "H" indicated by a waveform B-4 to the holding circuit 24. When the pump drive operation is completed, the residual quantity detecting means 60 is recovered to a normal state, and outputs the residual quantity detection signal "L". Therefore, when the delayed pump signal is input to the holding circuit 24, the holding circuit 24 outputs and holds the residual quantity detection signal "L". The alarm device 25 determines that the residual quantity of ink is "sufficient". In this manner, an erroneous detection signal produced by the detecting means 60 can be prevented from being transferred to the alarm device 25. If the detecting means 60 is erroneously operated for other causes and performs erroneous detection, the erroneous detection signal will not be transferred to the alarm 25 as long as this signal is simultaneously input to the holding circuit 24 together with the detection command signal.

When the right carriage turn signal C-3 is input to the delay circuit 21, the erroneous operation time of the detecting means 60 is delayed in the same manner as in the input pump signal, and the residual quantity detection signal from the detecting means 60 is held in the holding circuit 24. Therefore, the residual quantity detection signal can be input to the alarm device 25 in a normal state.

When a left carriage turn signal D-3 is input to the delay circuit 22, since the detecting means 60 performs normal detection as described above, the alarm device 25 can receive the normal detection signal from the detecting means 60.

Residual quantity detection when the residual quantity of ink in the ink tank 7 becomes "small" will be described.

When the recording operation is performed and the quantity of ink becomes "small", a change in pressure is caused in the ink supply system, as described above, and the terminals 60-8 and 60-9 of the detecting means 60 are disconnected from each other.

In this state, if a drive signal F-2 of the pump 9 is input to the detecting means 60; the detecting means 60 continuously outputs an "H" signal F-4. The holding circuit 24 receives an output command signal F-5 from the OR gate 23, and outputs and holds an "H" residual quantity detection signal F-5 to the alarm device 25. Therefore, the alarm device 25 produces an alarm sound indicating that the residual quantity of ink is "small".

When the residual quantity of ink is "small" and left carriage turn of the carriage 2 is performed, the residual quantity detection means 60 performs an erroneous operation as described above, and outputs an "L" residual quantity detection signal G4. However, when this carriage turn is completed, the detecting means 60 is recovered to a normal state, and outputs a detection output "H". The holding circuit 24 outputs the residual quantity detection signal "H" in response to the delayed left carriage signal i.e., the residual quantity detection command signal G5. Therefore, the erroneous detection signal from the detecting means 60 will not be transferred to the alarm device 25.

According to the eighth embodiment of the present invention as described above, while the recording operation is performed, the residual quantity of ink can be detected each time the pump is driven or the carriage turned, and an erroneous detection signal from the detecting means 60 caused by the drive operation of the pump or the carriage turn can be prevented from being output to the alarm device 25.

Figure 20:
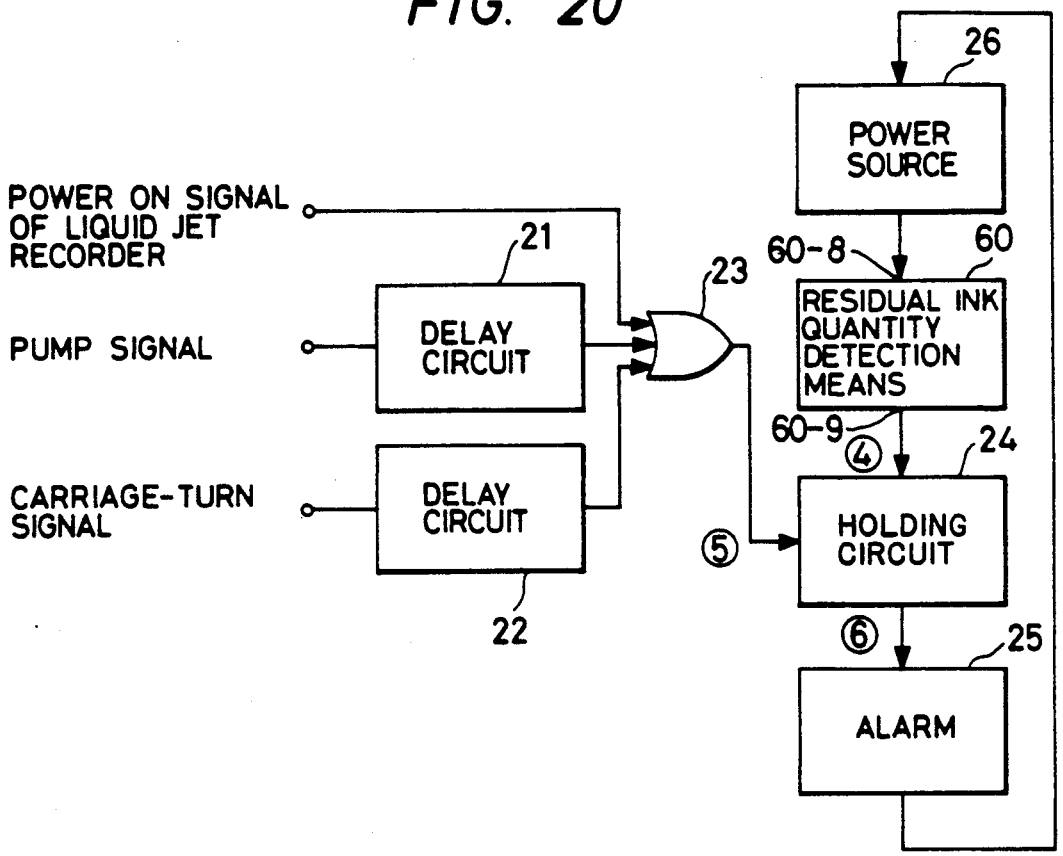
FIG. 20 is a block diagram showing a circuit arrangement in a ninth embodiment of the present invention.

FIG. 20 shows the arrangement of a ninth embodiment of the present invention.

The same reference numerals in FIG. 20 denote the same parts as in FIG. 18.

Referring to FIG. 20, a power source 26 supplies a current as a residual quantity detection signal to the residual quantity detecting means 60.

In the ninth embodiment, when the power-on signal, the carriage turn signal, and the pump drive signal are input to the OR gate 23, the OR gate 23 causes the holding circuit 24 to output the input residual quantity detection signal, in the same manner as in the eighth embodiment. Instead of inputting the output from the OR gate 23 to the detecting means 60, the power source 26 is arranged, so that the residual quantity detection signal is stably supplied to the detecting device 60.

In the ninth embodiment of the present invention, the power-on signal is input as a residual ink quantity detection command timing. However, in an ink-jet printer whose carriage 2 is moved to a home position, the timing can be taken in response to a home position movement signal.

In the eighth and ninth embodiments of the present invention, the recording head 1 is moved along the guide G. However, in a serial recording type inkjet printer having a plurality of recording heads aligned in line without the guide G, an erroneous detection of the detecting means 60 caused by the carriage turn cannot occur, and the carriage turn signal need not be input. However, if the frequency of signal detection is to be increased, the carriage turn signal can be input.

In the eighth and ninth embodiments of the present invention, the residual quantity detection timing is instructed in accordance with the drive start signal of the pump 9. However, the drive signal for driving the pump 9 can be used thereas, as a matter of course.

In the eighth and ninth embodiment of the present invention, the signal output timings of the pump signal and the carriage turn signal are delayed by the delay circuit 21 and 22. Instead of using the delay circuits 21 and 22, an arithmetic processing device for causing the holding circuit 24 to output and hold the detection signal after a predetermined period of time has passed from the input of the pump signal and the carriage turn signal can be used.

According to the eighth and ninth embodiments of the present invention as described above, residual ink quantity detection is performed at a timing at which an erroneous operation of the detecting means is completed. Therefore, the presence/absence of ink can be effectively detected without being influenced by the erroneous operation of the residual ink quantity detecting means caused by the drive operation of the ink supply pump or carriage turn.

Figure 21:
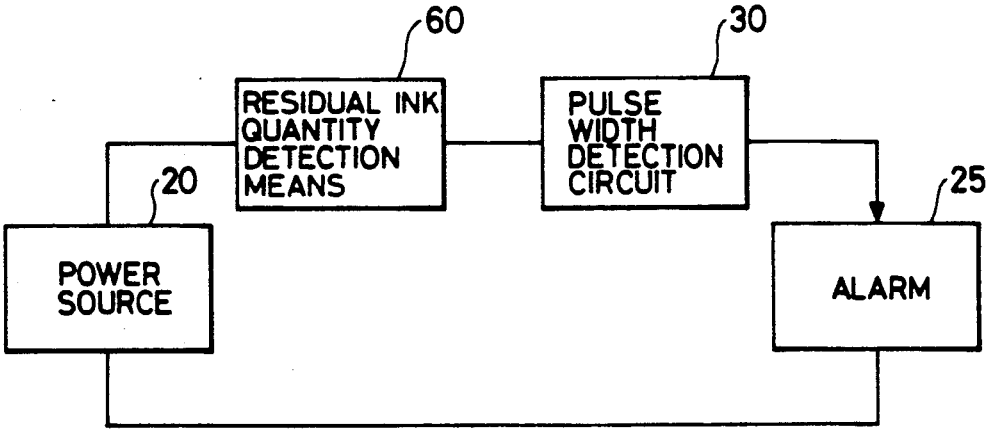
FIG. 21 is a block diagram showing a circuit arrangement in a tenth embodiment of the present invention.

FIG. 21 shows the arrangement according to a tenth embodiment of the present invention.

In FIG. 21, a power source 20 supplies a detection current to a residual ink quantity detecting means 60 that comprises a first detection signal generating means. An alarm device 25 receives a residual quantity detection signal indicating the presence/absence of ink from the residual quantity detecting means 60, and produces an alarm when the residual quantity of ink is "small". A pulse width detection circuit 30 according to the tenth embodiment of the present invention receives the residual quantity (first) detection signal, and counts a pulse width t1 of the detection signal. The detection circuit, or signal outputting means, 30 does not output a residual quantity detection signal having a pulse width smaller than a preset pulse width t, and outputs and holds a residual quantity detection signal input before the residual quantity detection signal having the pulse width smaller than the predetermined with is input.

An erroneous signal output interval of the residual quantity detecting means 60 due to the pump 9 or carriage turn is several seconds. Therefore, the predetermined pulse width can be set to be larger than the maximum erroneous signal output interval.

Figure 22:
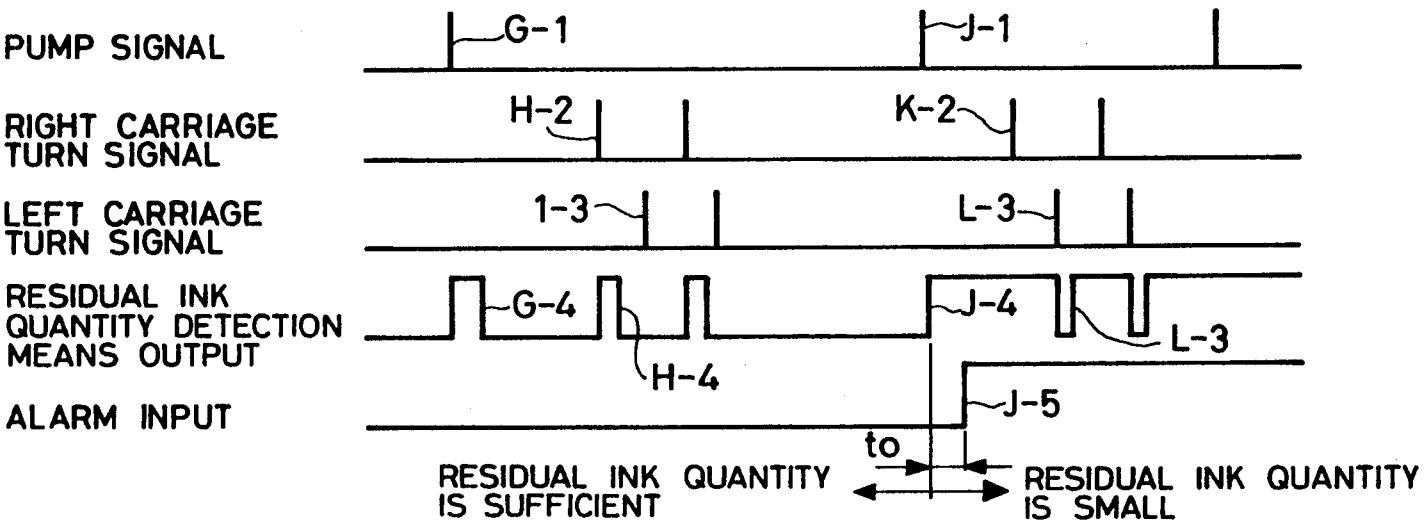
FIG. 22 is a timing chart showing the operation of a residual ink quantity detecting means 60 in the tenth embodiment of the present invention.

FIG. 22 shows the operation timing of the residual quantity detecting means 60 in the tenth embodiment of the present invention.

In FIG. 22, if the pump 9 is driven in response to a pump signal G-1 when the quantity of ink is "sufficient", the residual quantity detecting means 60 is erroneously operated as described above, and outputs a signal indicating the "small" residual quantity of ink, i.e., an "H" residual quantity detection signal G-4. When the carriage turn of the carriage 2 is performed in response to a carriage turn signal "H" for instructing the carriage turn, the detecting means 60 is also erroneously operated, and outputs an "H" residual quantity detection signal H-4.

The pulse width of the signal output from the detecting means 60 as a result of the erroneous operation is smaller than the predetermined pulse width of the pulse width detection circuit 30. Therefore, the detection circuit 30 outputs a signal "L" before signal 6-4 or H-4.

Therefore, an error signal from the residual quantity detecting means 60 cannot be transferred to the alarm device 25, and the alarm device 25 will not be erroneously operated.

When the residual quantity of ink becomes "small", the residual quantity detecting means 60 outputs a residual quantity detection signal "H". When the pulse width detection circuit 30 detects that this first detection signal has a pulse width larger than the predetermined pulse width t, it holds this signal to produce a second detection signal. Therefore, the alarm device 25 can detect the "small" quantity of ink, and produces an alarm. A detection delay time t is several seconds, and no problem occurs in an actual use.

If a left carriage turn of the carriage 2 is performed when the quantity of ink becomes "small", the detecting means 60 outputs an "L" residual quantity detection signal L-4. However, the detection circuit 30 causes this signal not to output to the alarm device 25, and the alarm device 25 holds the signal "H".

According to the tenth embodiment of the present invention as described above, even if the residual ink quantity detecting means is erroneously operated due to a drive operation of the ink supply pump or carriage turn, the alarm device can be normally operated. Therefore, the residual quantity of ink can be reliably detected.

Figure 23:
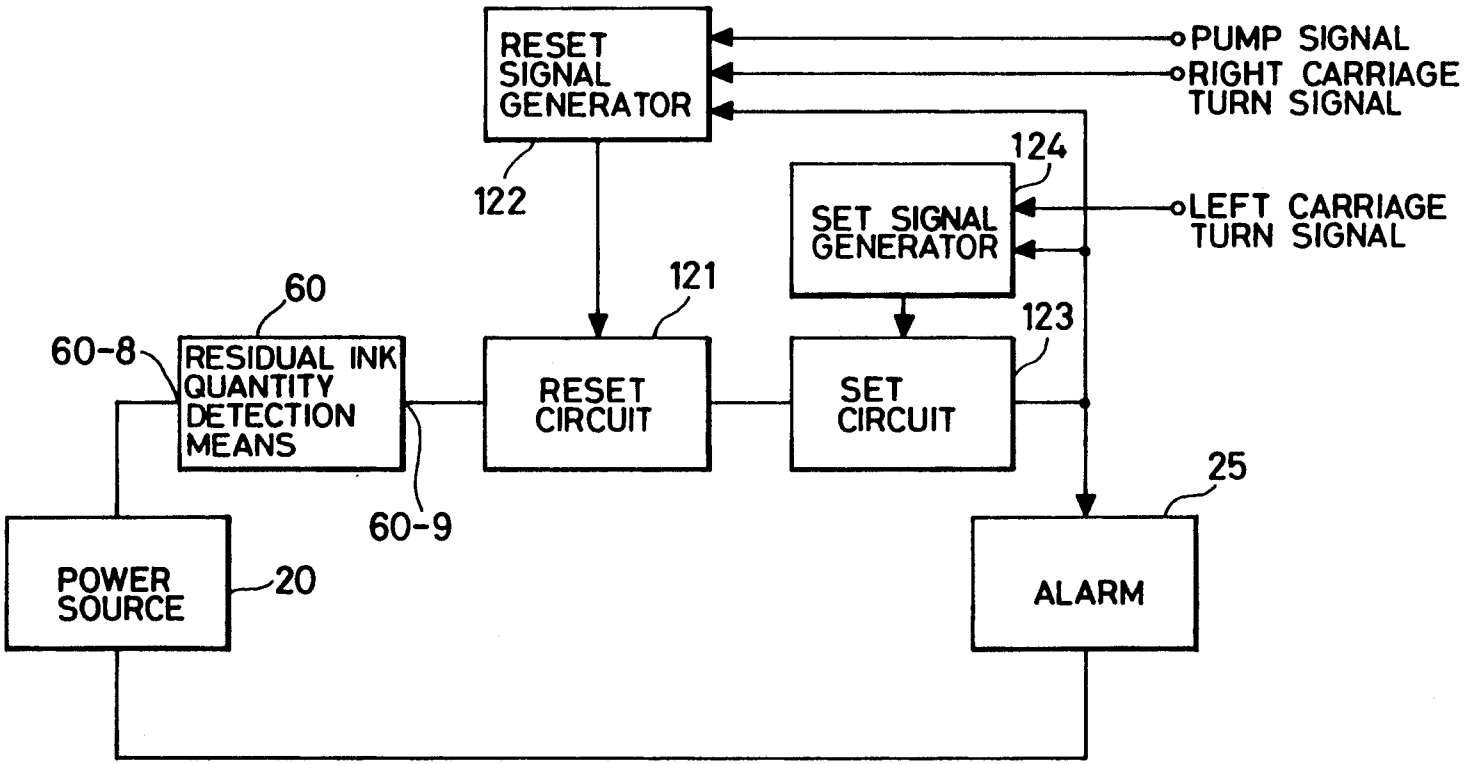
FIG. 23 is a block diagram showing a circuit arrangement in an 11th embodiment of the present invention.

FIG. 23 shows an 11th embodiment of the present invention.

An input terminal 60-8 of the residual quantity detecting means 60 is connected to a power source 20, and an output terminal 60-9 is connected to the input terminal of the alarm device 25 through a reset circuit 121 and a set circuit 123. When the residual quantity of ink becomes "small", the terminals 60-8 and 60-9 of the detecting means 60 are disconnected from each other, and the means 60 outputs a signal "H". When the residual quantity of ink is "sufficient", the detecting means 60 allows the current from the power source 20 to pass therethrough and outputs a signal "L". When the reset circuit 121 does not receive a reset signal from a reset signal generator 122, the circuit 121 outputs the input signal from the detecting means 60 (residual quantity detection signal) to the alarm device 25; otherwise, it sets its output signal at "L" level irrespective of the residual quantity detection signal (alarm device disable state).

When the set circuit 123 does not receive a set signal input from a set signal generator 124, it outputs the residual quantity detection signal; otherwise, it sets its output signal at "H" level irrespective of the residual quantity detection signal (alarm device enable state). The reset circuit 121 and the set circuit 123 perform set and reset processing using RS flip-flops.

The reset signal generator 122 produces a reset signal and outputs the signal to the reset circuit 121 in accordance with a reset timing.

The reset signal generator 122 receives a trigger pulse drive signal of the pump 9 or the right carriage turn signal for instructing right carriage turn signal of the carriage 2, and produces a pulse signal having a predetermined pulse width using a monostable multivibrator. The generator 122 outputs the pulse signal as a reset signal in accordance with this pulse signal and an output signal (alarm signal) from the set circuit 123.

When the alarm signal is at "H" level, the alarm device 25 is operated, and when the alarm signal is at "L" level, the alarm device 25 is not operated. More specifically, the reset signal generator 122 receives the pump drive signal, and outputs the reset signal to the reset circuit only when the alarm signal is at "L" level. During the operation of the pump 9, since the residual quantity detection signal "H" indicating the "small" residual quantity of ink is erroneously output, the residual quantity detection signal (error signal) is reset by the reset circuit 121, and is output to the alarm device 25 as a correct alarm signal.

When the carriage 2 performs a left carriage turn, the detecting device 60 erroneously outputs a residual quantity detection signal "L" (error signal) when the residual quantity of ink is "small" and the alarm signal is at "H" level. Therefore, the set signal generator 124 pulse-shapes the left carriage turn signal only when the alarm signal is at "H" level, and outputs a set signal to the set circuit 123. Therefore, the residual quantity detection signal (error signal) which is output from the detecting means 60 and passes through the reset circuit is set by the set circuit 123, and is output to the alarm device 25 as a correct alarm signal.

The operation of the 11th embodiment of the present invention will be described with reference to FIG. 24.

Figure 24:
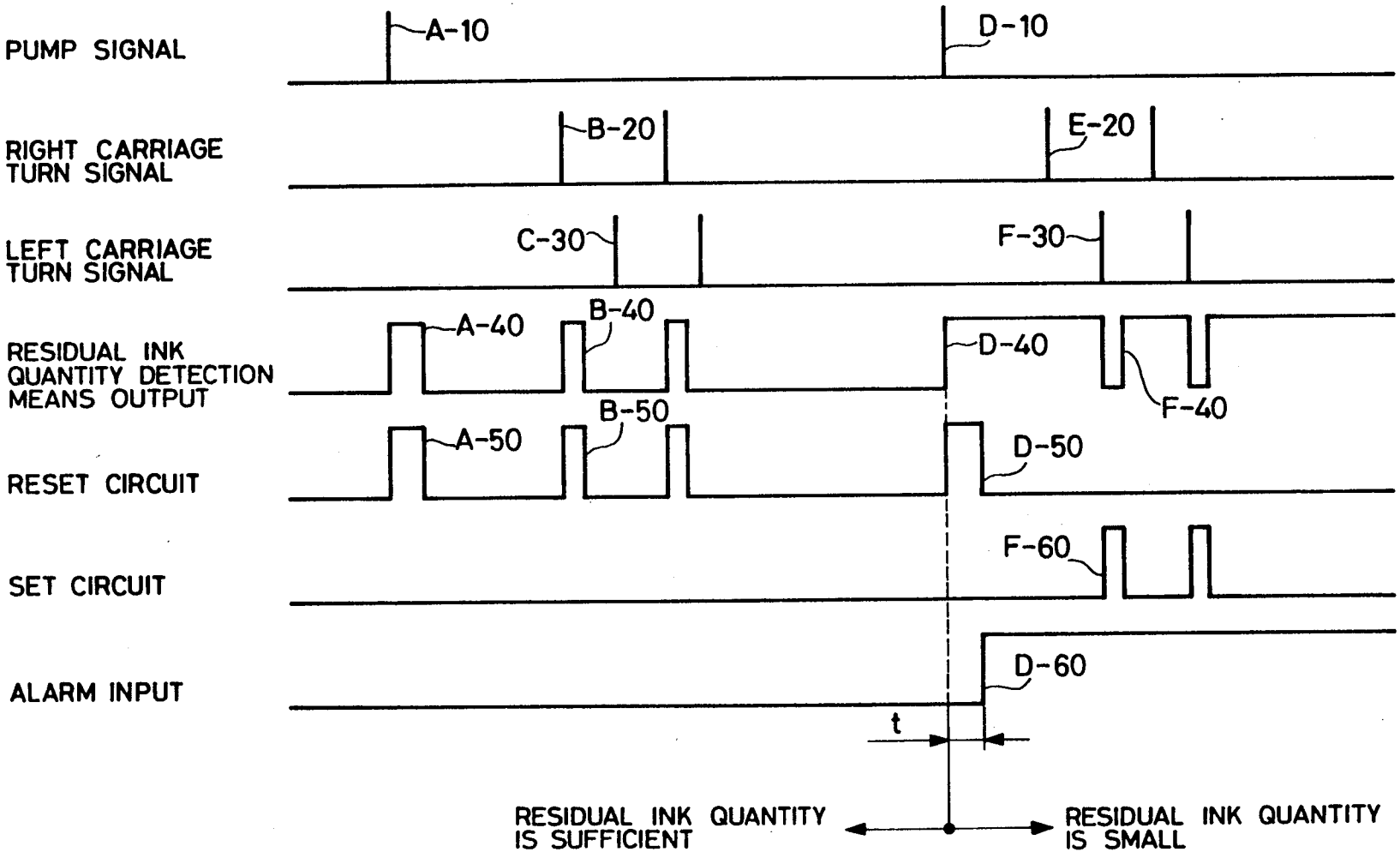
FIG. 24 is a timing chart showing input/output signals in respective devices in the 11th embodiment of the present invention.

FIG. 24 shows timings of input/output signals in the 11th embodiment of the present invention.

In FIG. 24, when the residual quantity of ink is "sufficient", the output from the residual quantity detecting means 60 represents an inoperative state "L". However, the terminals 60-8 and 60-9 of the detecting means 60 are disconnected by a negative pressure due to the pump 9 or the right carriage turn at a timing indicated by a waveform A-40, and a residual quantity detection signal "H" (erroneous operation output) is output. In this case, since the alarm device input is at "L" level, a reset signal A-50 formed by a pump signal A-10 or a right carriage turn signal C-30 (a reset signal B-50 in the case of the right carriage turn signal) is output. Therefore, when the detecting means 60 is erroneously operated in the case of the "sufficient" residual quantity of ink, the reset circuit 121 receives the reset signal and outputs the alarm signal "L" to the alarm device 25. Thus, the alarm device 25 does not produce an alarm. When a left carriage turn is performed, since the set signal generator 124 produces no set signal, the residual quantity detection signal "L" from the detecting means 60 is output to the alarm device 25 as the alarm signal.

When the residual quantity of ink is small, the detecting means 60 normally outputs a residual quantity detection signal "H". However, the detecting means 60 outputs a residual quantity detection signal "L" (erroneous operation output) as indicated by a waveform F-40 due to the pressure caused by the left carriage turn. In this case, since the alarm device 25 receives the "H" input, the set signal generator 124 outputs the set signal produced by the left carriage turn signal to the set circuit 123, thereby setting the residual quantity detection signal by the set circuit 123. Then, the alarm signal "H" is output to the alarm device 25. For this reason, when the detecting means 60 is erroneously operated in the case of the "small" residual quantity of ink, the set signal is input, and the input signal to the alarm device 25 can be kept in an operative state "H".

When the residual quantity of ink is changed from "sufficient" to "small" while the residual quantity detecting means 60 is normally operated, ink will be consumed. Therefore, a change in residual quantity can be detected during the printing operation wherein the pump is driven and the carriage turn signal is produced. In this case, the input to the alarm device 25 is delayed by time t with respect to the operation timing of the residual quantity detecting means. However, the time t is at most several seconds, and will not pose any serious problem during the use of the ink-jet printer.

Figure 25:
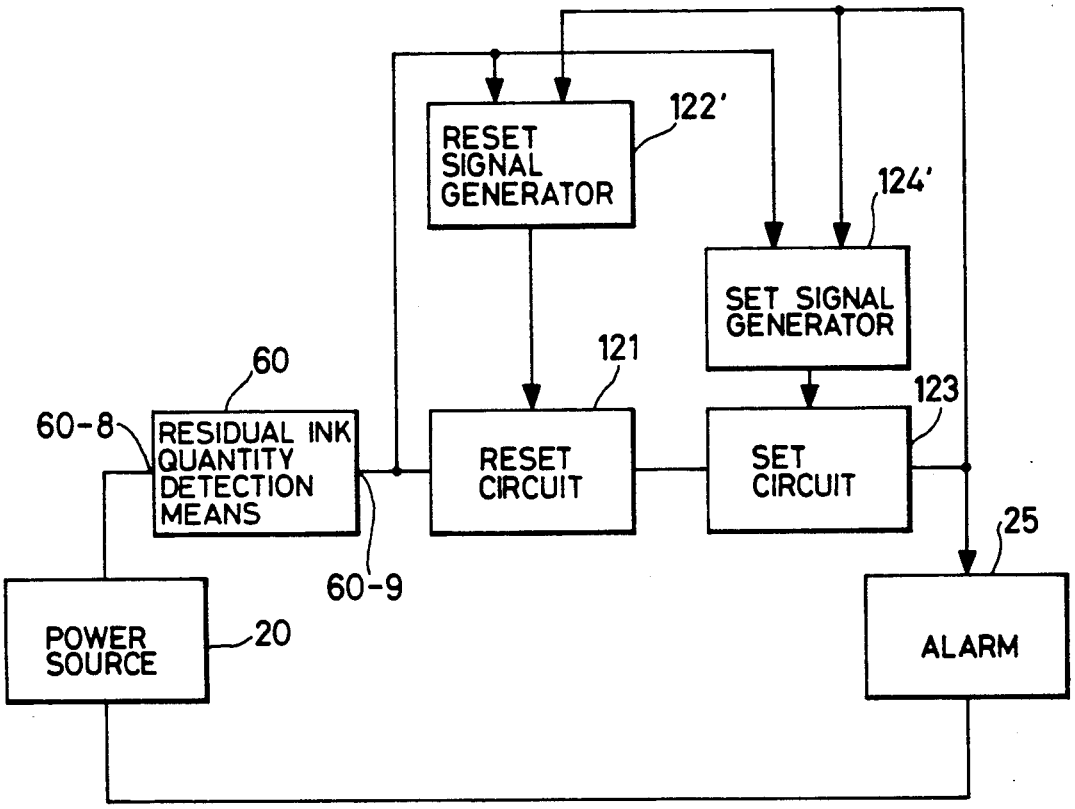
FIG. 25 is a block diagram showing a circuit arrangement in a 12th embodiment of the present invention.

FIG. 25 shows a circuit arrangement according to a 12th embodiment of the present invention.

The same reference numerals in FIG. 25 denote the same parts as in FIG. 23.

A reset signal generator 122 outputs a reset signal to the reset circuit 121 when it is detected that the detection signal from the residual quantity detecting means 60 goes from "L" level to "H" level, i.e., when the detecting means 60 is erroneously operated due to the operation of the pump 9 and a right carriage turn and when it is detected the residual quantity of ink is changed from "sufficient" to "small". A pulse width t is set to be a time larger than the pump erroneous operation time t1 and a carriage turn time t2. Therefore, if the pump 9 is driven or the carriage turn is performed when the quantity of ink is "sufficient", the residual quantity detection signal "H" output from the detecting means 60 is set using the reset signal output from the reset signal generator 122' in the reset circuit 121, and a correct alarm signal "L" is output from the reset circuit 121 to the alarm device 25. When the residual quantity of ink is changed from "sufficient" to "small", the reset signal is output from the reset signal generator 122' to the reset circuit 121. However, after the reset signal is output, the reset signal generator 122' receives the signal "H" from the detecting means 60 and will not output the reset signal. Therefore, the residual quantity detection signal "H" from the detecting means 60 is output to the alarm device 25 as the alarm signal. The residual quantity detection is delayed by the reset time t as indicated by a waveform D-60 in FIG. 24. However, this time is several seconds and poses no problem in an actual use of the ink-jet printer.

A set signal generator 124' detects the trailing edge of the erroneous operation signal "L" from the detecting means 60 caused by a left carriage turn when the input alarm signal to the alarm device 25 is at "H" level, and produces a set signal to the set circuit 123. When the set signal is output to the set circuit 123, the signal "L" output from the detecting means 60 is set by the set circuit 123, and is output to the alarm device 25 as the alarm signal "H". Therefore, the error signal from the detecting means 60 will not be transferred to the alarm device 25.

In this embodiment, the reset circuit 121 and the set circuit 123 comprise RS flip-flops. However, they can be circuits, constituted by AND gates or OR gates, which can produce a signal for compensating for an error signal from the residual quantity detecting means 60.

According to the 11th and 12th embodiments of the present invention as described above, the erroneous operation of the residual quantity detecting means is detected, and the erroneous operation signal can be compensated and output to the alarm device. Therefore, the residual quantity of ink can be reliably detected.

What we claim is:

1. An ink jet recording apparatus having a recording head for discharging ink to perform recording on a recording medium, an ink supply system for supplying ink to said recording head from an ink supply source, said ink supply system having a branched path branching therefrom, an ink quantity detecting means connected to said branched path for detecting a predetermined ink quantity in said ink supply system, said detecting means comprising:

a first detection signal generating means for selectively supplying a first detection signal having a continuation time period in a high or low state depending on whether or not an ink quantity is less or greater than the predetermined quantity, said first detection signal generating means including a resilient member disposed in said ink supply system between said ink supply source and said recording head, wherein one surface of said resilient member is in contact with ink to detect the ink quantity by detecting a shift of said resilient member;

signal outputting means cooperating with said first detection signal generating means for outputting a second detection signal, said signal outputting means being capable of detecting the continuation time period of the first detection signal and outputting the second detection signal only when the first detection signal is supplied in the state indicating the ink quantity is less than the predetermined quantity and the continuation time period of the first detection signal is longer than a predetermined time period, wherein said signal outputting means does not generate the second detection signal when the continuation time period of the first detection signal is shorter than the predetermined time period; and alarm means connected electrically with said signal outputting means for producing an alarm signal in response to the second detection signal.

2. An inkjet recording apparatus according to claim 1, further comprising opening/closing means for opening and closing said branched path.

3. An ink jet recording apparatus according to claim 2, wherein said branched path is closed by said opening/closing means when the ink quantity is not detected.

4. An ink jet recording apparatus having a recording head for discharging ink to perform recording on a recording medium and an ink supply system for supplying ink to said recording head from an ink supply source, said ink supply system having a internal space and a branched path branching from said ink supply system, the apparatus comprising:

ink quantity detecting means for detecting a predetermined ink quantity in said ink supply system and for generating a first detection signal having a continuation time period when an ink quantity is smaller than the predetermined quantity, wherein said ink quantity detecting means includes resilient releasing means for releasing the internal space of said ink supply system to atmosphere and is connected to said branched path;

opening/closing means in said ink supply system for opening and closing said branched path;

signal outputting means cooperating with said ink quantity detecting means for outputting a second detection signal, said signal outputting means being capable of detecting the continuation time period of the first detection signal and outputting the second detection signal when the continuation time period of the first detection signal is longer than a predetermined time period; and alarm means connected electrically with said signal outputting means for producing an alarm when the second detection signal is inputted thereinto.

5. An ink jet recording apparatus according to claim 4, wherein when a quantity of ink is detected, said releasing means is closed to shield the said ink supply system from atmosphere and said opening/closing means is opened.

6. An ink jet recording apparatus having a recording head for discharging ink to perform recording on a recording medium, an ink supply system for supplying ink to said recording head from an ink supply source, ink quantity detecting means for detecting a predetermined ink quantity in said ink supply system, and pump means for supplying ink from said ink supply source to said recording head through said ink supply system, said detecting means comprising:

a first detection signal generating means for selectively supplying a first detection signal having a continuation time period in a high or low state depending on whether or not an ink quantity is less or greater than the predetermined quantity, said first detection signal generating means including a resilient member disposed in said ink supply system between said ink supply source and said recording head, wherein one surface of said resilient member is in contact with ink to detect the ink quantity by detecting a shift of said resilient member;

signal outputting means cooperating with said first detection signal generating means for outputting a second detection signal, said signal outputting mean being capable of detecting the continuation time period of the first detection signal and outputting the second detection signal only when the first detection signal is supplied in the state indicating the ink quantity is less than the predetermined quantity and the continuation time period of the first detection signal is longer than a predetermined time period, wherein said signal outputting means does not generate the second detection signal when the continuation time period of the first detection signal is shorter than the predetermined time period; and information means for producing an information signal in response to the second detection signal.

7. An ink jet recording apparatus according to claim 6, further comprising a sub-tank provided between said ink quantity detecting mans and said recording head.

8. An ink jet recording apparatus according to claim 6, wherein said ink supply source includes a detachable flat ink bag.

9. An ink jet recording apparatus according to claim 6, wherein ink quantity detection is carried out by detecting the ink quantity in said ink supply source.

10. An ink jet recording apparatus according to claim 6, wherein said ink quantity detecting means includes:

a deviation member connected to an ink supply path of said ink supply system and comprising part of said path, wherein said deviation member is deviated upon a change in pressure in the said path;

an adjusting member for adjusting a deviation of said deviation member in order to set a pressure at which said deviation member is deviated; and detection means for detecting the deviation of said deviation member.

11. An ink jet recording apparatus according to claim 10, wherein said ink quantity detecting means has a fixed first electrode, and a second electrode provided on said deviation means to be brought into contact with said first electrode in accordance with the deviation of said deviation member.

12. An ink jet recording apparatus according to claim 10, wherein said ink quantity detecting means includes fixed light emitting means, light receiving means, and a shielding member associated with said deviation member for interrupting an optical path between said light emitting means and said light receiving means.

13. An ink jet recording apparatus according to claim 6, wherein said ink supply system includes an attachable/detachable ink tank.

14. An ink jet recording apparatus according to claim 6, wherein said information means comprises alarm means for producing an alarm in response to the second detection signal.

15. An ink jet recording apparatus according to claim 6, further comprising a cap member for covering discharge ports in said recording head, wherein said pump means generates a negative pressure in said cap member and in said ink supply system to draw ink from said ink supply source through said discharge ports.

16. An ink jet recording apparatus having a main body, a carriage mounted for movement relative to said main body, a recording head mounted on said carriage for discharging ink to perform recording on a recording medium, an ink supply system for supplying ink to said recording head from an ink supply source on said main body, and ink quantity detecting means for detecting a predetermined ink quantity in said ink supply system, said detecting means comprising:

a first detection signal generating means for selectively supplying a first detection signal having a continuation time period in a high or low state depending on whether or not an ink quantity is less or greater than the predetermined quantity, said first detection signal generating means including a resilient member disposed in said ink supply system between said ink supply source and said recording head, wherein one surface of said resilient member is in contact with ink to detect the ink quantity by detecting a shift of said resilient member;

signal outputting means cooperating with said first detection signal generating means for outputting a second detection signal, said signal outputting means being capable of detecting the continuation time period of the first detection signal and outputting the second detection signal only when the first detection signal is supplied in the state indicating the ink quantity is less than the predetermined quantity and the continuation time period of the first detection signal is longer than a predetermined time period, wherein said signal outputting means does not generate the second detection signal when the continuation time period of the first detection signal is shorter than the predetermined time period; and information means for producing an information signal in response to the second detection signal.

17. An ink jet recording apparatus according to claim 16, wherein said ink quantity detecting means includes:

a deviation member connected to an ink supply path of said ink supply system and comprising part of said path, wherein said deviation member is deviated upon a change in pressure in said path;

an adjusting member for adjusting a deviation of said deviation member in order to set a pressure at which said deviation member is deviated; and detection means for detecting the deviation of said deviation member.

18. An ink jet recording apparatus according to claim 17, wherein ink quantity detecting means has a fixed first electrode, and a second electrode provided on said deviation means to be brought into contact with said first electrode in accordance with the deviation of said deviation member.

19. An ink jet recording apparatus according to claim 17, wherein said ink quantity detecting means includes fixed light emitting means, light receiving means, and a shielding member associated with said deviation member for interrupting an optical path between said light emitting means and said light receiving means.

20. An ink jet recording apparatus according to claim 16, wherein said ink supply system includes an attachable/detachable ink tank.

21. an ink jet recording apparatus according to claim 16, further comprising a sub-tank provided between said ink quantity detecting means and said recording head.

22. An ink jet recording apparatus according to claim 16, wherein said ink supply source includes a detachable flat ink bag.

23. An ink jet recording apparatus according to claim 16, wherein ink quantity detection is carried out by detecting the ink quantity in said ink supply source.

24. An ink jet recording apparatus according to claim 16, wherein said information means comprises alarm means for producing an alarm in response to the second detection signal.

* * * * *

UNITED STATES PATENT AND TRADEMARK OFFICE

CERTIFICATE OF CORRECTION

PATENT NO. : 5,136,309
DATED : August 4, 1992
INVENTOR(S) : Hiroshi Iida, et. al.

It is certified that error appears in the above-indentified patent and that said Letters Patent is hereby corrected as shown below:

COLUMN 3

Line 10, "thereby:" should read --thereby--.
Line 34, "carriage-2" should read --carriage 2--
and "cause" should read --caused--.

COLUMN 7

Line 39, "adjusting-" should read --adjusting--.
Line 40, "turned" should read --turned,--.

COLUMN 8

Line 3, "FIG. 4," should read --FIG. 7,--.

COLUMN 10

Line 13, "capping 10" should read --capping device 10--.
Line 17, "an" should read --and--.
Line 23, "capping 10," should read --capping device 10,--.

COLUMN 12

Line 10, "shows-a-control" should read
--shows a control--.
Line 33, "capping 9" should read --capping device 10--.
Line 37, "a-" should read --a--.

UNITED STATES PATENT AND TRADEMARK OFFICE

CERTIFICATE OF CORRECTION

PATENT NO. : 5,136,309
DATED : August 4, 1992
INVENTOR(S) : Hiroshi Iida, et. al.

It is certified that error appears in the above-indentified patent and that said Letters Patent is hereby corrected as shown below:

COLUMN 21

Line 7, "inkjet" should read --ink jet--.
Line 18, "a" should read --an--.
Line 46, "the" should be deleted.

COLUMN 22

Line 4, "mean" should read --means--.

COLUMN 24

Line 9, "ink quantity detecting means" should read --said ink quantity detecting means--.
Line 23, "an" should read --An--.

Signed and Sealed this

Nineteenth Day of October, 1993

Bruce Lehman

*Attest:*

BRUCE LEHMAN

*Attesting Officer*

*Commissioner of Patents and Trademarks*